US012708206B2

(12) United States Patent
Bryant

(10) Patent No.: US 12,708,206 B2
(45) Date of Patent: Aug. 18, 2026

(54) HIGH-LEG RECLINER SEATING MECHANISM

(71) Applicant: L&P Property Management Company, South Gate, CA (US)

(72) Inventor: Jason Allan Bryant, Mooreville, MS (US)

(73) Assignee: L&P Property Management Company, Carthage, MO (US)

( * ) Notice: Subject to any disclaimer, the term of this patent is extended or adjusted under 35 U.S.C. 154(b) by 149 days.

(21) Appl. No.: 18/603,434

(22) Filed: Mar. 13, 2024

(65) Prior Publication Data

US 2024/0315453 A1 Sep. 26, 2024

Related U.S. Application Data

(60) Provisional application No. 63/464,676, filed on May 8, 2023, provisional application No. 63/454,092, filed on Mar. 23, 2023.

(51) Int. Cl.
*A47C 1/0355* (2013.01)
*A47C 1/032* (2006.01)

(52) U.S. Cl.
CPC ..... *A47C 1/0355* (2013.01); *A47C 1/03211* (2013.01)

(58) Field of Classification Search
CPC ... A47C 1/0355; A47C 1/03211; A47C 17/04; A47C 1/035; A47C 3/14; A47C 7/54; A47C 1/0242; A47C 17/163; A47C 17/175; A47C 17/1756
See application file for complete search history.

(56) References Cited

U.S. PATENT DOCUMENTS 2,567,612 A * 9/1951 Mcgehee ..... A47C 3/0255 248/370
3,233,939 A 2/1966 Chapman
3,572,820 A * 3/1971 Ferguson ..... A47C 1/0355 297/84
3,768,859 A * 10/1973 Rogers, Jr. ..... A47C 1/0355 297/69
4,114,610 A * 9/1978 Koch ..... A61H 1/02 601/24
4,247,146 A * 1/1981 Cycowicz ..... A47C 1/0355 297/340
4,915,444 A * 4/1990 Rogers, Jr. ..... A47C 1/0355 297/69

(Continued)

FOREIGN PATENT DOCUMENTS

CN 112006467 A 12/2020
WO 2023/019925 A1 2/2023

OTHER PUBLICATIONS

Invitation to Pay Additional Fees received for PCT Patent Application No. PCT/US2025/026328, mailed on Jun. 24, 2025, 3 pages.

(Continued)

*Primary Examiner* — Medhat Badawi
(74) *Attorney, Agent, or Firm* — Shook, Hardy & Bacon L.L.P.

(57) ABSTRACT

An ottoman linkage is provide for use on a high leg seating unit. The ottoman linkage has a lower overall height in the closed position, allowing it to be used on a high leg seating unit, while remaining obscured from sight.

8 Claims, 23 Drawing Sheets

(56) References Cited

U.S. PATENT DOCUMENTS 4,989,914 A * 2/1991 Pine ..... A47C 1/0355 297/85 L
5,013,084 A * 5/1991 May ..... A47C 1/0355 297/86
5,087,094 A * 2/1992 Rogers, Jr. ..... A47C 1/0355 297/69
5,110,179 A * 5/1992 Rogers ..... A47C 1/0355 297/75
5,186,518 A * 2/1993 Pine ..... A47C 1/0355 297/85 L
5,219,204 A * 6/1993 Bathrick ..... A61G 5/14 297/DIG. 10
5,326,153 A * 7/1994 Muffi ..... A47C 17/04 297/DIG. 7
5,419,611 A * 5/1995 Cook ..... A47C 1/0355 297/75
5,503,453 A 4/1996 Saul et al.
5,772,278 A * 6/1998 Kowalski ..... A47C 1/0355 297/85 L
5,823,614 A * 10/1998 Johnson ..... A47C 1/0352 297/452.4
5,975,627 A * 11/1999 LaPointe ..... A47C 1/0355 297/83
6,120,095 A * 9/2000 Rogers ..... A47C 1/0352 248/370
7,040,692 B1 * 5/2006 Pine ..... A47C 3/027 297/85 L
7,475,944 B2 * 1/2009 Griepentrog ..... A47C 17/175 297/85 L
7,607,180 B2 * 10/2009 Griepentrog ..... A47C 17/165 5/47
8,622,467 B2 * 1/2014 Murphy ..... A47C 1/036 297/83
8,696,054 B2 4/2014 Crum
8,714,638 B2 5/2014 Hoffman et al.
9,241,571 B2 * 1/2016 Robertson ..... A47C 1/031
9,326,615 B1 * 5/2016 LaPointe ..... A47C 7/506
9,351,576 B1 * 5/2016 Rogers ..... A47C 1/0355
9,375,089 B2 6/2016 Lawson et al.
9,386,857 B2 7/2016 Lawson et al.
9,398,810 B2 7/2016 Donovan et al.
9,408,466 B2 8/2016 Flamme
9,433,294 B2 * 9/2016 Donovan ..... A47C 7/5068
9,603,453 B2 3/2017 Hoffman et al.
10,021,980 B2 7/2018 Lawson
10,123,620 B2 * 11/2018 Donovan ..... A47C 1/0242
10,182,659 B2 * 1/2019 Kuhl ..... A47C 17/86
10,258,158 B2 4/2019 Fei et al.
10,299,597 B1 5/2019 Crum
10,349,745 B2 7/2019 Huang et al.
10,383,442 B2 8/2019 Lawson
10,420,422 B2 9/2019 Lawson et al.
10,485,719 B2 11/2019 Murphy
10,653,243 B2 5/2020 Lawson et al.
D885,783 S * 6/2020 Menescardi ..... D6/381
10,709,246 B2 7/2020 Murphy
10,842,274 B1 * 11/2020 Crawford ..... A47C 1/0345
10,874,574 B1 * 12/2020 Ruby ..... A61G 15/02
10,881,209 B2 1/2021 Bryant
10,897,995 B2 1/2021 Crum et al.
10,932,570 B2 3/2021 Crawford et al.
11,076,700 B2 * 8/2021 Kuhl ..... A47C 17/04
11,110,023 B1 * 9/2021 Knight ..... A47C 1/03211
11,178,970 B1 * 11/2021 Crum ..... A47C 1/0355
11,452,378 B1 9/2022 Li et al.
11,457,742 B1 * 10/2022 Zhang ..... A47C 4/02
11,478,083 B1 * 10/2022 Li ..... A47C 17/04
11,517,109 B2 * 12/2022 Browning ..... A47C 1/03211
11,540,633 B2 1/2023 Zhang
11,564,496 B1 * 1/2023 Li ..... A47C 1/0355
11,617,446 B2 * 4/2023 Zhang ..... A47C 7/5068 297/423.26
11,638,483 B2 5/2023 Sun et al.
11,690,453 B2 7/2023 Zhang
11,700,942 B2 7/2023 Li et al.
11,730,267 B2 * 8/2023 Lawson ..... A47C 3/029 297/85 L
11,737,561 B2 * 8/2023 Schuster ..... A47C 1/0355 297/423.19
11,766,123 B2 * 9/2023 Feng ..... A47C 17/04 297/68
11,903,485 B1 * 2/2024 Lawson ..... A47C 1/0355
11,944,199 B2 * 4/2024 Li ..... A47C 1/035
12,082,698 B2 * 9/2024 Liu ..... A47C 1/0345
12,089,742 B2 9/2024 Murphy
12,478,192 B2 11/2025 Liu et al.
12,502,000 B1 12/2025 Liu
12,520,941 B1 1/2026 Zhou et al.
12,532,965 B2 1/2026 Li et al.
2002/0093227 A1 * 7/2002 Williams ..... A47C 17/04 297/116
2003/0022771 A1 * 1/2003 Stearns ..... A63B 21/4047 482/142
2003/0022772 A1 * 1/2003 Stearns ..... A63B 23/0405 482/142
2003/0057743 A1 * 3/2003 May ..... A47C 1/0355 297/84
2004/0012231 A1 * 1/2004 Hesse ..... A47C 1/0355 297/85 M
2005/0104420 A1 * 5/2005 Murphy ..... A47C 1/0355 297/85 L
2005/0253430 A1 * 11/2005 George ..... A47C 1/124 297/233
2006/0061147 A1 * 3/2006 Johnson ..... A47C 1/0355 297/85 L
2006/0249993 A1 * 11/2006 Rogers ..... A47C 1/0355 297/68
2007/0257525 A1 * 11/2007 Wiecek ..... A47C 1/0355 297/30
2008/0001442 A1 * 1/2008 Wiecek ..... A47C 1/0355 297/85 L
2008/0111402 A1 * 5/2008 Crum ..... A47C 1/0355 297/85 R
2009/0174251 A1 * 7/2009 Lawson ..... A47C 1/0355 297/316
2010/0283297 A1 * 11/2010 Crum ..... A47C 7/50 297/423.28
2011/0175404 A1 * 7/2011 Lawson ..... A47C 3/027 297/83
2011/0175426 A1 * 7/2011 Lawson ..... A47C 1/0355 297/85 M
2011/0181094 A1 * 7/2011 Lawson ..... A47C 1/035 297/85 R
2011/0193373 A1 * 8/2011 Lawson ..... A47C 1/029 297/71
2011/0233972 A1 * 9/2011 Weicek ..... A47C 3/02 297/84
2011/0291460 A1 * 12/2011 Murphy ..... A61G 5/14 297/85 M
2011/0304193 A1 * 12/2011 Murphy ..... A47C 1/034 297/85 M
2012/0049606 A1 * 3/2012 Lawson ..... A47C 1/0355 74/521
2012/0104827 A1 5/2012 Murphy et al.
2012/0112518 A1 5/2012 Murphy et al.
2012/0112519 A1 * 5/2012 Murphy ..... A47C 1/0355 297/85 M
2012/0146364 A1 * 6/2012 Hoffman ..... A47C 1/03266 297/84
2013/0011335 A1 * 1/2013 Xie ..... G01N 33/5008 514/19.5
2013/0014327 A1 * 1/2013 Downey ..... A47C 7/42 5/632
2013/0175847 A1 * 7/2013 Lawson ..... A61G 5/14 297/85 M
2013/0200659 A1 * 8/2013 Hoffman ..... A47C 1/035 297/84
2014/0049084 A1 * 2/2014 Lawson ..... A47C 1/032 297/340

(56) References Cited

U.S. PATENT DOCUMENTS

2014/0167482 A1* 6/2014 Myre ..... A47C 7/002 297/463.1
2015/0054315 A1* 2/2015 Donovan ..... A47C 1/0345 297/325
2015/0054316 A1* 2/2015 Donovan ..... A47C 1/0342 297/313
2015/0272329 A1* 10/2015 Lawson ..... A47C 1/0355 297/342
2015/0272335 A1* 10/2015 Lawson ..... A47C 7/506 297/423.19
2015/0282619 A1* 10/2015 Lawson ..... A47C 1/0355 297/83
2015/0289655 A1* 10/2015 Lawson ..... A47C 1/0342 297/75
2016/0022040 A1* 1/2016 Lawson ..... A47C 1/03211 297/68
2016/0029800 A1* 2/2016 Bryant ..... A47C 1/0242 297/284.3
2016/0045031 A1* 2/2016 Lawson ..... A47C 7/506 297/284.3
2016/0073785 A1* 3/2016 Mackert ..... A47C 1/0345 297/423.19
2016/0088942 A1* 3/2016 Murphy ..... A47C 1/0345 297/361.1
2016/0106220 A1* 4/2016 Bryant ..... A47C 3/027 297/423.28
2016/0332541 A1* 11/2016 Bowen ..... A47C 1/03211
2016/0367030 A1* 12/2016 Donovan ..... A47C 1/0242
2018/0027967 A1* 2/2018 Lawson ..... A47C 1/0355
2018/0027968 A1* 2/2018 Lawson ..... A47C 1/0355
2018/0064255 A1* 3/2018 Lawson ..... A47C 7/5068
2018/0094711 A1* 4/2018 Lawson ..... F16H 25/20
2018/0103761 A1* 4/2018 White ..... A47C 1/0352
2018/0242740 A1* 8/2018 Lawson ..... A47C 1/0355
2018/0242742 A1* 8/2018 Lawson ..... A47C 1/0355
2018/0242746 A1* 8/2018 Lawson ..... A47C 1/124
2019/0216221 A1* 7/2019 Bryant ..... A47C 1/023
2019/0290004 A1* 9/2019 Lawson ..... A47C 1/0355
2019/0290005 A1* 9/2019 Bryant ..... A47C 1/0355
2019/0298070 A1* 10/2019 Lawson ..... A47C 1/0355
2020/0085197 A1* 3/2020 Lucas ..... A47C 15/004
2020/0100593 A1* 4/2020 He ..... A47C 7/38
2020/0100596 A1* 4/2020 He ..... A47C 17/00
2020/0113333 A1* 4/2020 Crum ..... A47C 1/0355
2020/0196759 A1* 6/2020 Johnson ..... A47C 1/03211
2020/0275781 A1* 9/2020 Lawson ..... A47C 3/029
2020/0305604 A1* 10/2020 Browning ..... A47C 1/0355
2020/0352333 A1* 11/2020 Lapointe ..... A47C 1/0242
2020/0352334 A1* 11/2020 Browning ..... A47C 1/0355
2020/0367652 A1* 11/2020 Crawford ..... A47C 1/0355
2021/0386202 A1* 12/2021 Crum ..... A47C 1/0355
2022/0015543 A1* 1/2022 Bryant ..... A47C 1/0242
2022/0346552 A1* 11/2022 Crawford ..... A47C 1/0355
2023/0017194 A1* 1/2023 Slater ..... A47C 17/04
2023/0068014 A1* 3/2023 Sun ..... A47C 1/03211
2023/0200536 A1* 6/2023 Beech ..... A47C 31/008 297/463.1
2023/0232987 A1* 7/2023 Brandtner ..... A47C 5/12 297/452.55
2023/0380597 A1* 11/2023 Li ..... A47C 1/0355
2024/0023713 A1* 1/2024 Murphy ..... A47C 1/0345
2024/0041215 A1* 2/2024 Spong ..... A47C 1/03255
2024/0049885 A1* 2/2024 Kamiya ..... A47C 7/54
2024/0081540 A1* 3/2024 Chen ..... A47C 7/541
2024/0108136 A1* 4/2024 Crum ..... A47C 1/0355
2024/0122346 A1* 4/2024 Murphy ..... A47C 1/0355
2024/0138568 A1* 5/2024 Yang ..... A47C 1/0355
2024/0138577 A1* 5/2024 Yang ..... A47C 1/03211
2024/0148144 A1* 5/2024 Li ..... A47C 1/0345
2024/0148145 A1* 5/2024 Li ..... A47C 1/0355
2024/0148148 A1* 5/2024 Shao ..... A47C 4/028
2024/0156262 A1* 5/2024 Li ..... A47C 1/0355
2024/0156263 A1* 5/2024 Li ..... A47C 1/0347
2024/0156274 A1* 5/2024 Hall ..... B66D 1/60
2024/0164527 A1* 5/2024 Li ..... A47C 7/5068
2024/0206632 A1* 6/2024 Shi ..... A47C 19/022
2024/0215726 A1* 7/2024 Li ..... A47C 1/0345
2024/0277145 A1* 8/2024 Li ..... A61G 5/14
2024/0277150 A1* 8/2024 Cooper ..... A47C 15/006
2024/0292953 A1* 9/2024 Lake ..... A47C 1/121
2024/0298805 A1* 9/2024 Li ..... A47C 7/5068
2024/0315452 A1* 9/2024 Bryant ..... A47C 1/0355
2024/0315453 A1* 9/2024 Bryant ..... A47C 1/03211
2024/0335039 A1* 10/2024 Lake ..... A47C 1/0355
2024/0335042 A1* 10/2024 Liu ..... A47C 1/024
2024/0341478 A1* 10/2024 Zhao ..... A47C 3/03
2024/0341479 A1* 10/2024 Murphy ..... A47C 1/0355
2024/0358156 A1* 10/2024 Wu ..... A47C 7/546
2024/0365979 A1* 11/2024 Lawson ..... A47C 1/0355
2024/0365980 A1* 11/2024 Crawford ..... A47C 1/0355
2024/0374031 A1* 11/2024 Tan ..... A47C 1/0355
2024/0374032 A1* 11/2024 Sun ..... A47C 1/0355
2024/0389751 A1* 11/2024 Sun ..... A47C 1/03211
2024/0407545 A1* 12/2024 Shi ..... H04R 1/025
2024/0423369 A1* 12/2024 Loccioni ..... A47C 1/0342
2025/0000260 A1* 1/2025 Cai ..... A47C 1/0355
2025/0040707 A1 2/2025 Cai et al.
2025/0040708 A1* 2/2025 Lake ..... A47C 1/0355
2025/0040709 A1* 2/2025 Lake ..... A47C 1/0355
2025/0057317 A1* 2/2025 Zhou ..... A47C 17/86
2025/0064212 A1 2/2025 Yap
2025/0072610 A1 3/2025 Zhao et al.
2025/0072611 A1 3/2025 Tsay
2025/0072612 A1* 3/2025 Zhao ..... A47C 1/0355
2025/0082099 A1* 3/2025 Ye ..... A47C 1/03211
2025/0089893 A1 3/2025 Hane
2025/0089902 A1* 3/2025 Chen ..... A47C 17/2076
2025/0098864 A1* 3/2025 Shi ..... A47C 7/541
2025/0107624 A1* 4/2025 Dick ..... A47C 1/0355
2025/0134256 A1* 5/2025 Conner ..... A47C 1/12
2025/0151906 A1* 5/2025 Yang ..... A47C 1/0355
2025/0151907 A1 5/2025 Sun et al.
2025/0151908 A1* 5/2025 Lei ..... A47C 1/0242
2025/0160520 A1* 5/2025 Cai ..... A47C 1/0345
2025/0160521 A1* 5/2025 Cai ..... A47C 1/0345
2025/0228368 A1 7/2025 Wang et al.
2025/0228369 A1 7/2025 Lawson
2025/0241454 A1 7/2025 Jacobs et al.
2025/0248521 A1* 8/2025 Jiang ..... A47C 1/0345
2025/0248522 A1 8/2025 Sun et al.
2025/0261757 A1* 8/2025 Crum ..... A47C 1/03211
2025/0280955 A1* 9/2025 Murphy ..... A47C 15/004
2025/0288112 A1* 9/2025 Ding ..... A47C 7/624
2025/0288113 A1 9/2025 Charlery
2025/0288116 A1* 9/2025 Shi ..... A47C 17/17
2025/0295236 A1 9/2025 Johnson et al.
2025/0338963 A1 11/2025 Li et al.
2025/0344859 A1 11/2025 Lin
2025/0366615 A1 12/2025 Jiang
2025/0366622 A1 12/2025 Huang et al.
2025/0380805 A1 12/2025 Lawson
2025/0386936 A1 12/2025 Lei et al.
2026/0020672 A1 1/2026 Tao et al.
2026/0026624 A1 1/2026 Zhao et al.
2026/0026625 A1 1/2026 Cai et al.
2026/0041239 A1 2/2026 Jiang
2026/0047680 A1 2/2026 Zhou et al.
2026/0047687 A1 2/2026 Lu et al.

OTHER PUBLICATIONS

International Preliminary Report on Patentability received for PCT Patent Application No. PCT/US2024/020554, mailed on Oct. 2, 2025, 13 pages.
International Search Report and Written Opinion received for PCT Patent Application No. PCT/US2025/026328, mailed on Aug. 21, 2025, 15 pages.
International Search Report and Written Opinion received for PCT Patent Application No. PCT/US2024/020554, mailed on Jul. 26, 2024, 16 pages.
Invitation to Pay Additional Fees received for PCT Patent Application No. PCT/US2024/020554, mailed on May 29, 2024, 3 pages.

(56) References Cited

OTHER PUBLICATIONS

Non-Final Office Action received for U.S. Appl. No. 18/651,852, mailed on Mar. 5, 2026, 12 pages.

* cited by examiner

HIGH-LEG RECLINER SEATING MECHANISM

CROSS REFERENCE TO RELATED APPLICATIONS

This application is claims priority to U.S. Application No. 63/454,092 (filed Mar. 23, 2023), and U.S. Application No. 63/464,676 (filed May 8, 2023), which are incorporated herein by reference in their entireties.

TECHNICAL FIELD

Embodiments of the present invention relate to an ottoman linkage for use on a chair with a high-leg design, and to recliner seating mechanisms and chairs using them, and particularly to a powered recliner seating mechanism with an ottoman linkage and motor that are hidden from view when in a stored position.

BACKGROUND OF THE INVENTION

One design of chairs using a reclining mechanism is known as a high-leg design. In these types of chairs, the legs suspend the seat above a flooring surface such that one can see under the chair. In a chair having a powered ottoman linkage mechanism and/or a reclining mechanism, and a high-leg styling, it is desirable to provide a mechanism and motor that can be completely hidden from sight, without altering the overall design of the chair.

BRIEF DESCRIPTION OF THE INVENTION

A seating unit is provided that is moveable between closed, extended and fully reclined positions. The seating unit comprises two sides spaced from one another, each side having a lower edge and an upper edge, a seat extending between the two sides, an extendable ottoman and a chair back extending upwardly from a rearward edge of the seat. The seating unit further comprises a pair of side plates, each side plate coupled to a corresponding one of the two sides; a linkage mechanism supported between the side plates and coupling at least the seat, the ottoman, and the chair back, the linkage mechanism having a height in the closed position and a lowest-most extent, wherein the lowest most extent is above the lower edge of the sides; and a motor coupled to the linkage mechanism to move the seating unit between the closed, extended and fully reclined positions.

In other aspects, an ottoman linkage is provided that is movable between a closed, stowed position and an extended position, without also moving the seat or back, but while still providing an extendable ottoman while still allowing a high-leg styling.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

Embodiments of the present invention generally relate to a seating unit having a motorized mechanism, usable on a high-leg styled chair, that is hidden from view and that moves the ottoman from a closed position to an extended position, and can recline the back of the seating unit with the ottoman extended.

Figure 1:
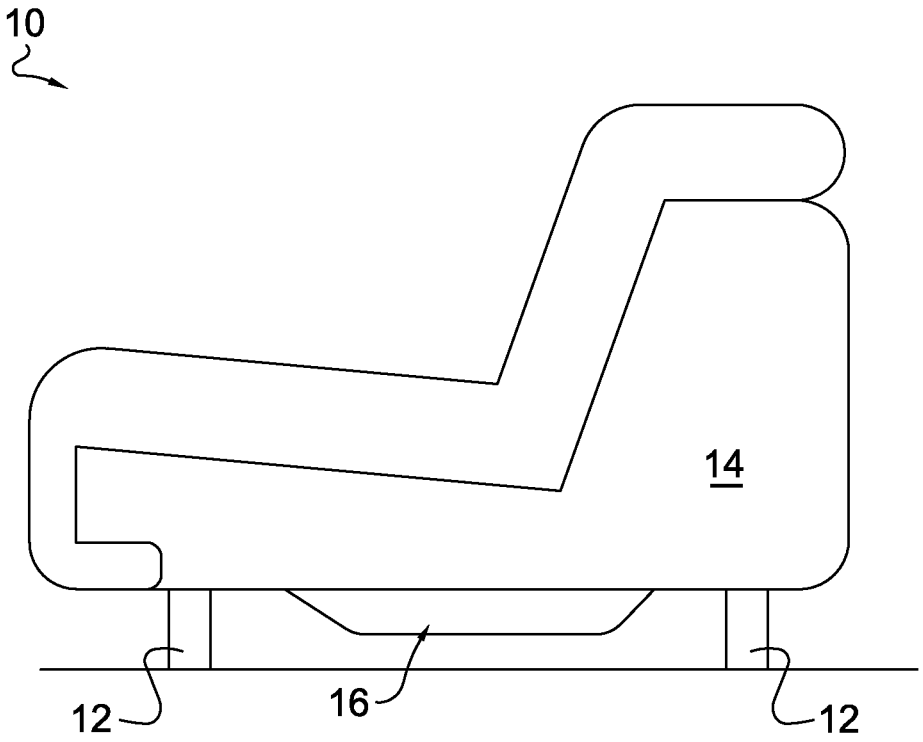
FIG. 1. PRIOR ART
FIG. 1 is a side view of a prior art high leg chair, in which a portion of the linkage mechanism is exposed in the closed position.

As shown in FIG. 1, a prior art high-leg chair 10 may have legs 12 that support the sides 14 above a support surface (such as a floor). The chair 10 may include a mechanism 16 that allows the chair 10 to move from a closed position to an extended position and to a fully-reclined position. As shown in FIG. 1, certain portions of the mechanism 16 may be exposed and visible in the closed position (such as portions of links, portions of support tubes, or portions of the motor), which is undesirable. The chair designer and manufacturer is left with the option of leaving those certain portions of the mechanism 16 visible, or changing the style and shape of the chair sides to obscure those portions of the mechanism. It would be desirable to provide a mechanism that does not require the chair designer and manufacturer to choose between these two options.

Figure 2:
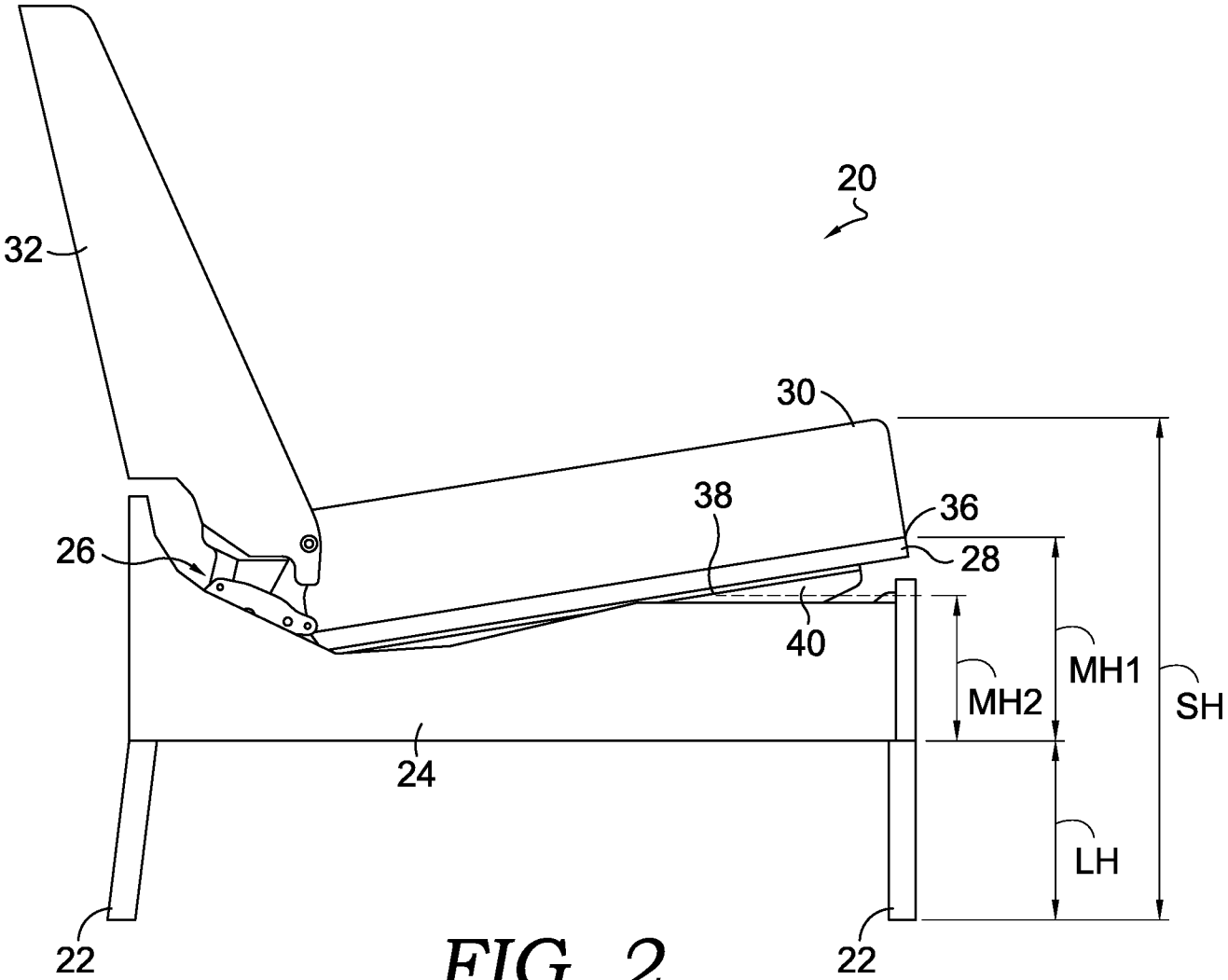
FIG. 2 is a side view of a seating unit in accordance with an embodiment of the invention.
Figure 3:
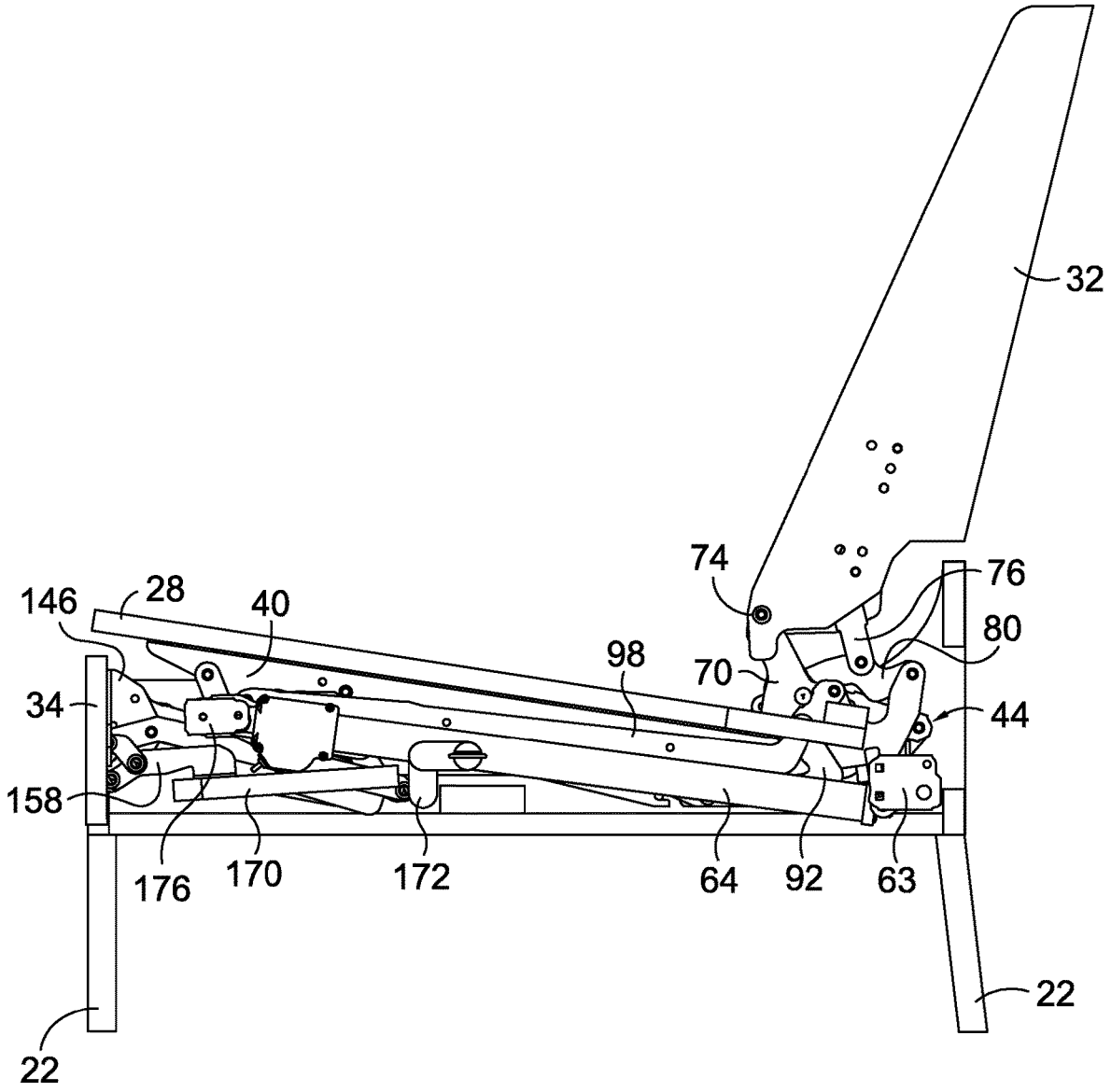
FIG. 3 is a view similar to FIG. 2, but showing the opposite side, and without the side frame and seat upholstery.

A seating unit 20 is shown in FIG. 2 in a closed position. The seating unit 20, in some aspects, has legs 22 that support the remainder of the seating unit 20 above the floor or other support surface. The seating unit 20 may also include a side frame 24 that supports a linkage mechanism 26 (shown in more detail in other figures). The seating unit 20, in some aspects, may also have arms (not shown). The mechanism 26 is coupled to a seat frame 28 that supports a seat 30, a back frame 32 (which supports upholstery which is not shown) and an ottoman 34 (see FIG. 3, which is discussed further below). The mechanism 26 allows the seating unit 20 to use what is known as "high-leg" styling with a very compact mechanism height that allows the side frame 24 to obscure mechanism 26 from view, and that allows the chair to be placed close to an adjacent wall (a wall-proximity chair). As seen in FIG. 2, the legs 22 support the seating unit above the floor at a leg height (LH) measured from the floor to the lower edge of the side frame 24. In some aspects, the leg height is between seven and eight inches. In some aspects, the seat 30 is positioned above the floor at a seat height (SH) that may be about 20 inches. The space between the lower edge of the side frame 24 and the lower edge of the seat frame 28 is occupied by the mechanism 26. Because the seat frame 28 typically sits at an angle, the space available for the mechanism height (MH) may be measured from different points. In some aspects, a mechanism height (MH1) may be the distance from the lower edge of the side frame 24 to a top and front edge 36 of the seat frame 28. In other aspects, a mechanism height (MH2) may be the distance from the lower edge of the side frame 24 to a point 38 (discussed further below) on a seat rail 40 that obscures the majority of the mechanism 26. With a very compact mechanism 26, designers of the seating unit 20 are able to provide a higher leg distance (LH) and a lower seat height (SH) if that is desired, while still offering a wall-proximity chair. This is made possible by the mechanism 26 with a lower mechanism height (MH) than was previously possible. For example, in some aspects, MH2 is in the range of about 140 mm to 160 mm, compared with prior mechanisms where a comparable MH2 is 170 mm or more. The mechanism 26 thus allows a three-way reclining (moving between closed, TV and fully-reclined positions), wall-proximity chair, with a seat height (SH) comparable to other chairs in the market, but with a higher leg height (LH), while offering a mechanism that is hidden from view in the closed position.

Figure 5:
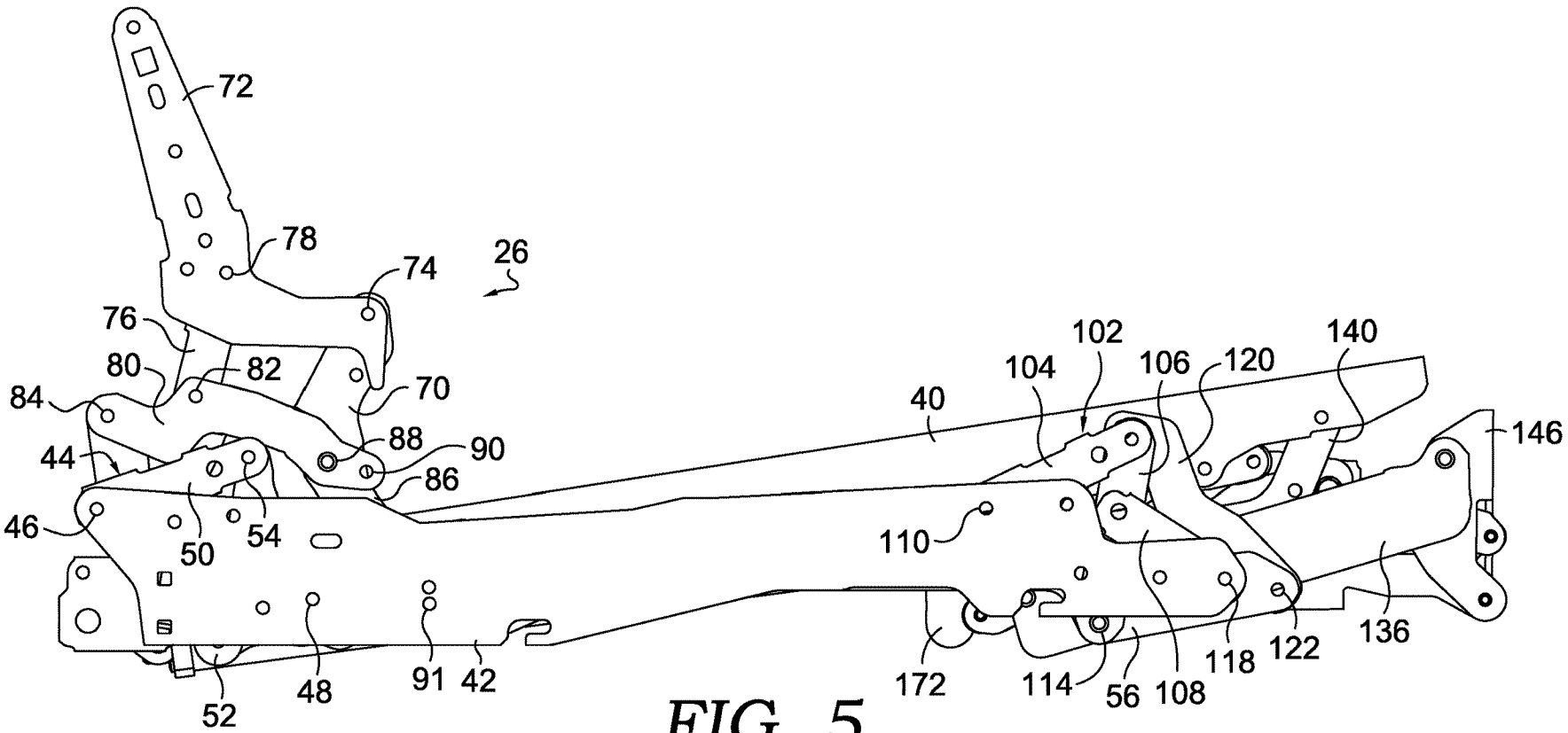
FIG. 5 is a side view of the mechanism of FIG. 4.
Figure 6:
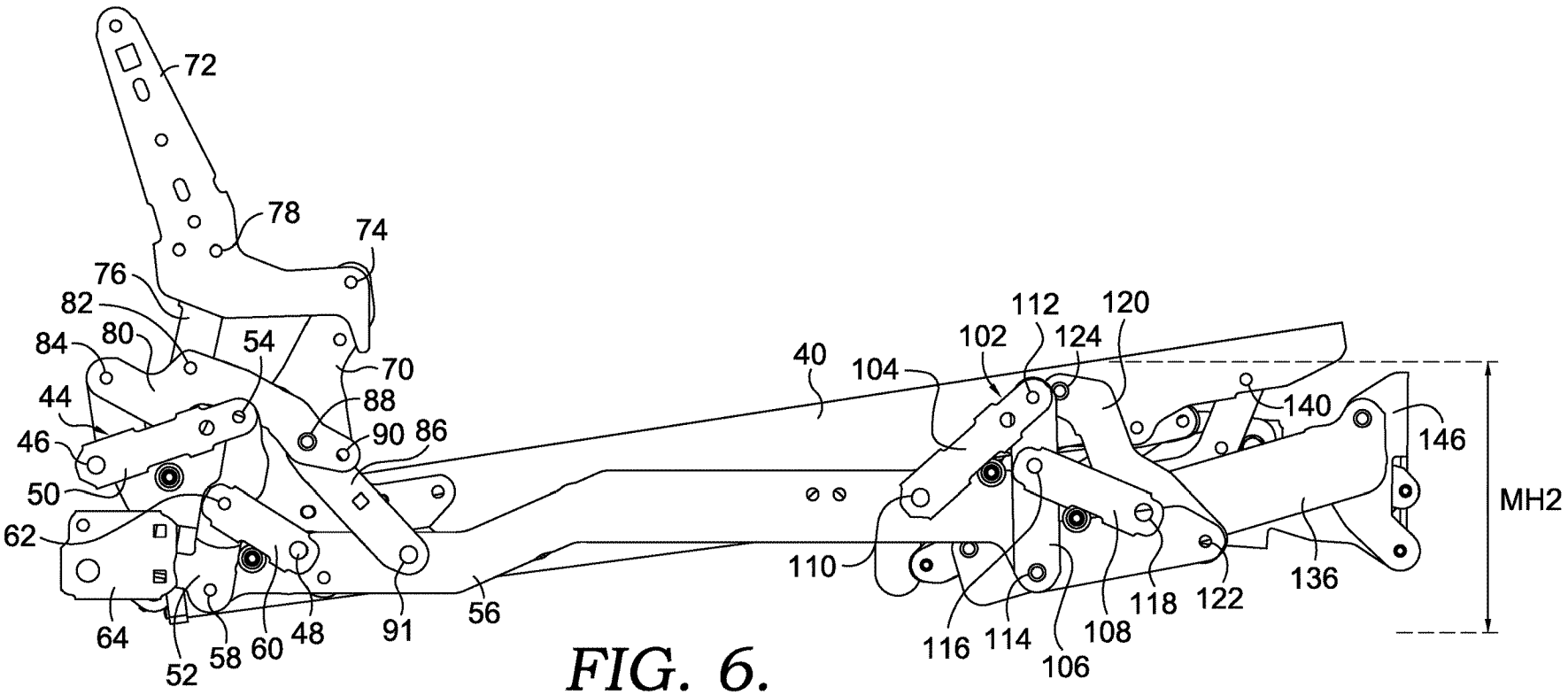
FIG. 6 is a view similar to FIG. 5, shown without the arm plate.

As shown in FIG. 5, the mechanism 26 includes an arm mounting plate 42 that is used to couple the mechanism 26 to the side frame 24. A rear recline linkage 44 is pivotally coupled to the arm mounting plate 42 at pivot points 46 and 48. The rear recline linkage 44 includes a control link 50 that is pivotally coupled to the arm mounting plate at pivot point 46. As seen in FIG. 6, the control link 50 (opposite pivot point 46) is pivotally coupled to a rear travel link 52 at pivot point 54. The other end of the rear travel link 52 is pivotally coupled to a trolley link 56 at pivot point 58. Generally mid-way between pivot point 54 and pivot point 58, the rear travel link 52 is pivotally coupled to a pivot control link 60 at pivot point 62. The end of the pivot control link 60 opposite pivot point 62 is pivotally coupled to the arm mounting plate at pivot point 48. As will be further discussed below, the rear recline linkage 44 (including the control link 50, the rear travel link 52 and the pivot control link 60) is located more rearwardly, and higher, than in previous mechanisms, allowing for a very compact mechanism 26.

Figure 4:
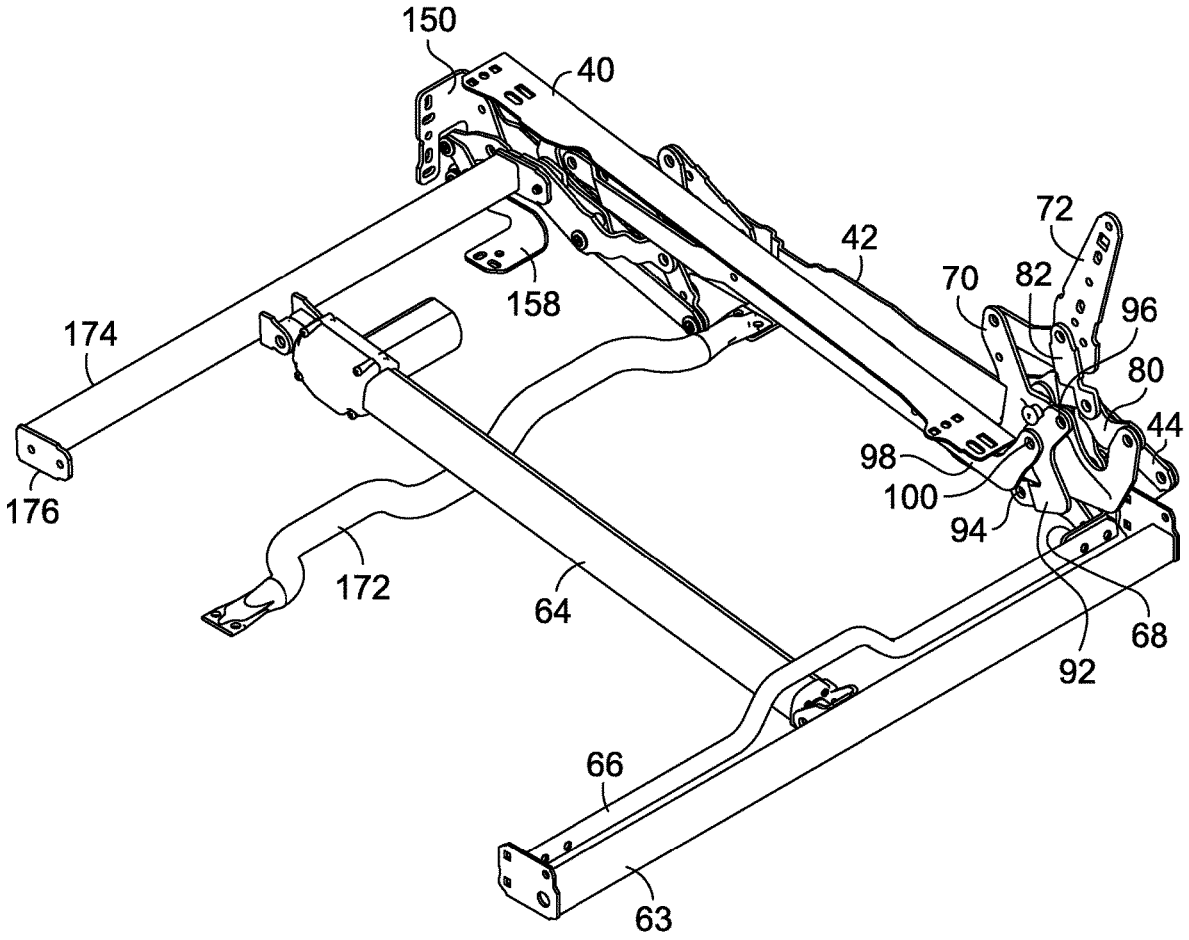
FIG. 4 is a perspective view of the linkage mechanism of seating unit of FIGS. 2 and 3.

As seen in FIG. 4, a rear motor tube 63 is coupled between opposing arm mounting plates 42. The rear motor tube 63 pivotally supports a motor 64 as more-fully described below. Additionally, a rear stabilizer tube 66 is fixedly coupled to the lower end of rear travel link 52 with a flange 68 (as seen in FIG. 4). The rear stabilizer tube 66 extends between opposing rear travel links 52.

As seen in FIGS. 4 and 5, a seat plate extension 70 is fixedly coupled to the seat rail 40. The combination of the seat rail 40 and the seat plate extension 70 may be referred to as a seat plate. The seat plate extension 70 generally extends rearwardly and upwardly from the seat rail 40. A back bracket 72 is pivotally coupled to the seat plate extension 70 at pivot point 74. The back bracket 72 is used to support the back frame 32 of the seating unit 20, and the back frame 32 moves in connection with the movement of the back bracket 72. Rearwardly of pivot point 74, the back bracket 72 is pivotally coupled to a back support link 76 at pivot point 78, as best seen in FIG. 5. The other end of the back support link 76 is pivotally coupled to a rear bell crank 80 at pivot point 82. As best seen in FIG. 5, the rear bell crank 80 is pivotally coupled to a rear, upper end of the seat plate extension 70 at pivot point 84. The opposite end of the rear bell crank 80 is pivotally coupled to a rear toggle link 86 at pivot point 88. In some aspects, the rear bell crank 80 may support a stop pin 90 that extends away from the rear bell crank 80 and abuts the rear toggle link 86 in the closed position. Opposite pivot point 88, the rear toggle link 86 is pivotally coupled to the arm mounting plate 42 at pivot point 91 (compare FIG. 5 FIG. 6).

Figure 8:
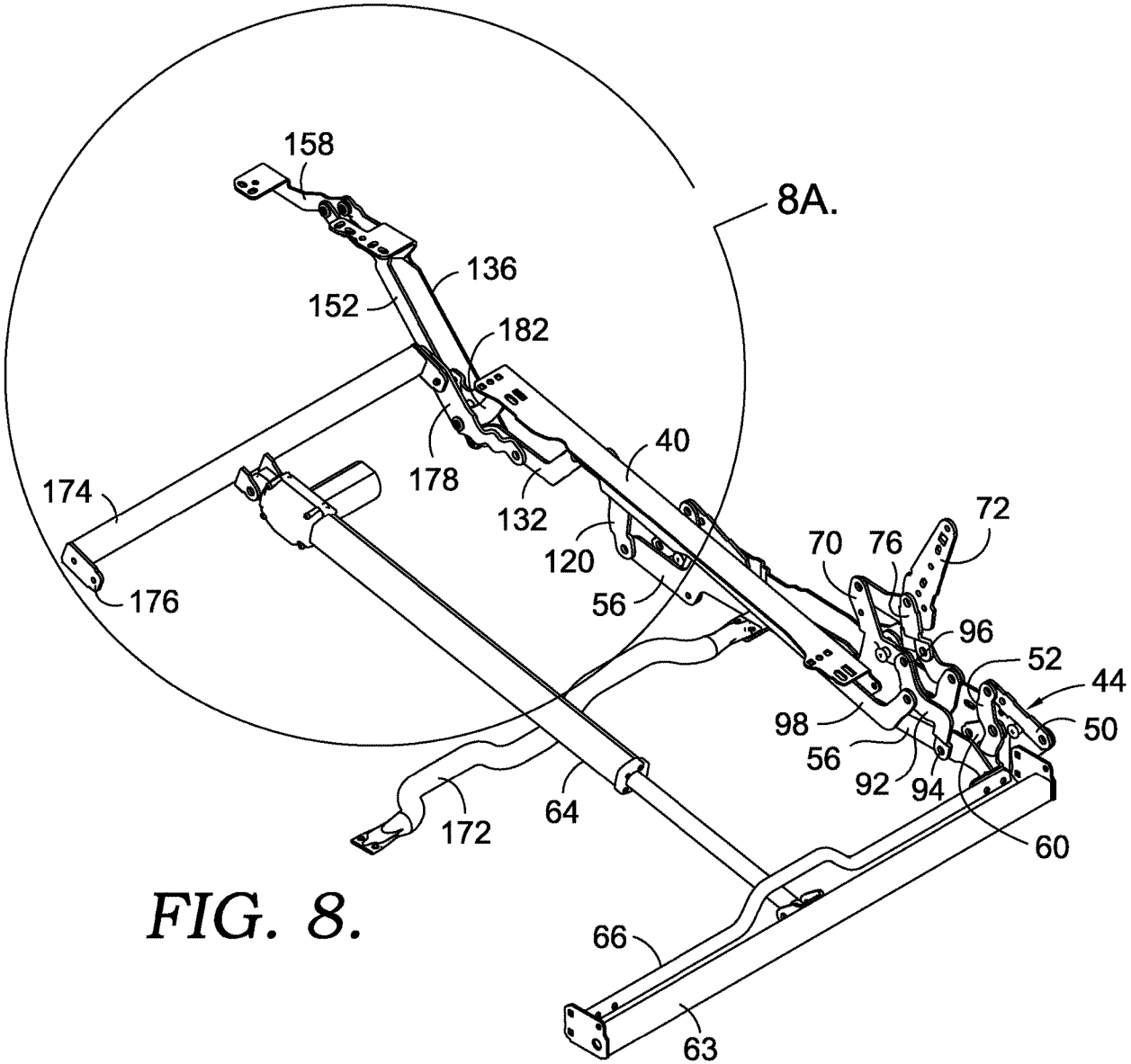
FIG. 8 is a perspective view similar to FIG. 4, but with the mechanism in the TV position.
Figure 12:
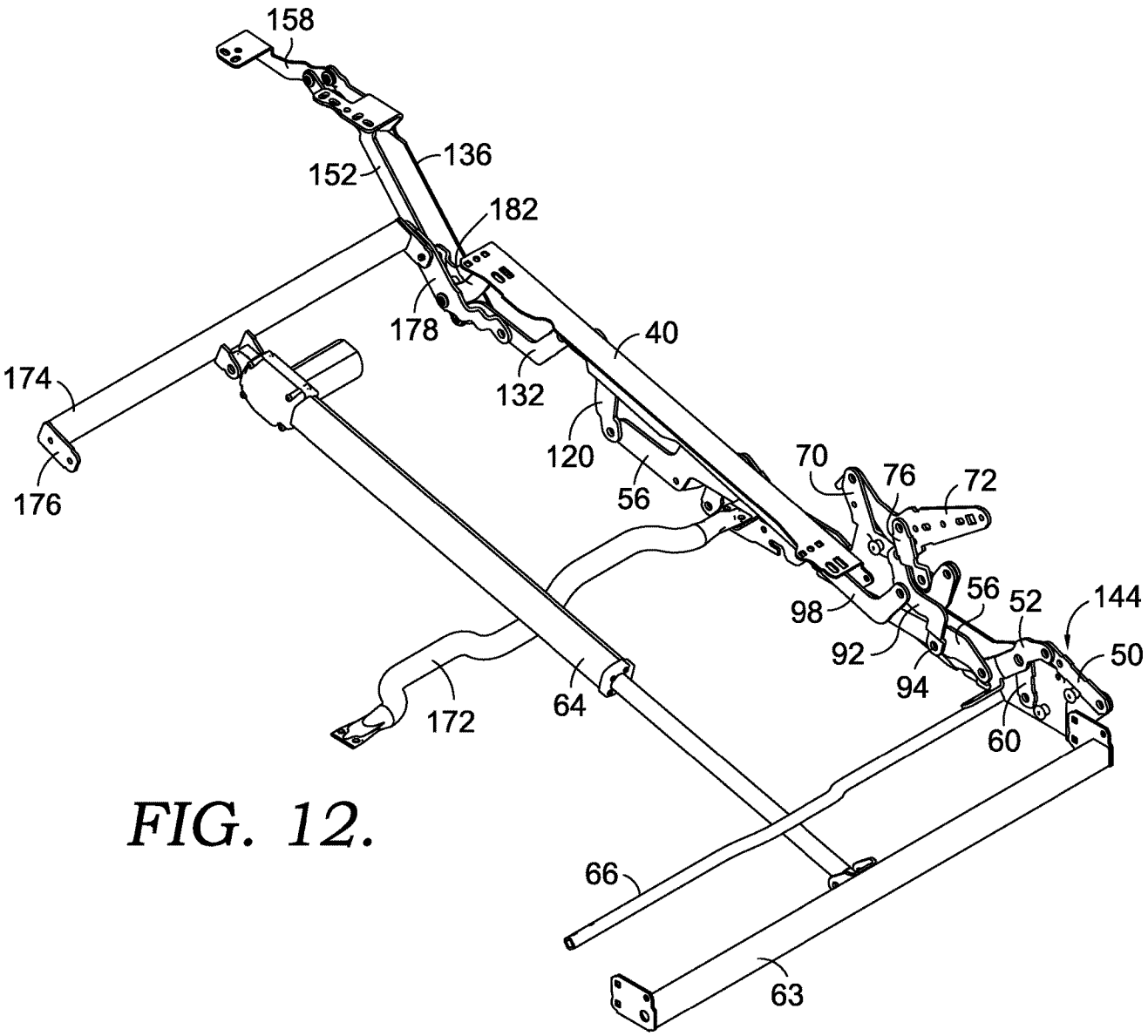
FIG. 12 is a perspective view similar to FIG. 8, but with the mechanism in the fully reclined position.

As seen in FIGS. 4, 8, and 12, a rear pivot link 92 is pivotally coupled on one end to the trolley link 56 at pivot point 94. The opposite end of rear pivot link 92 is pivotally coupled to the seat plate extension 70 at pivot point 96. Part way between pivot point 94 and pivot point 96, the rear pivot link 92 is pivotally coupled to an ottoman drive link 98 at pivot point 100.

Figure 13:
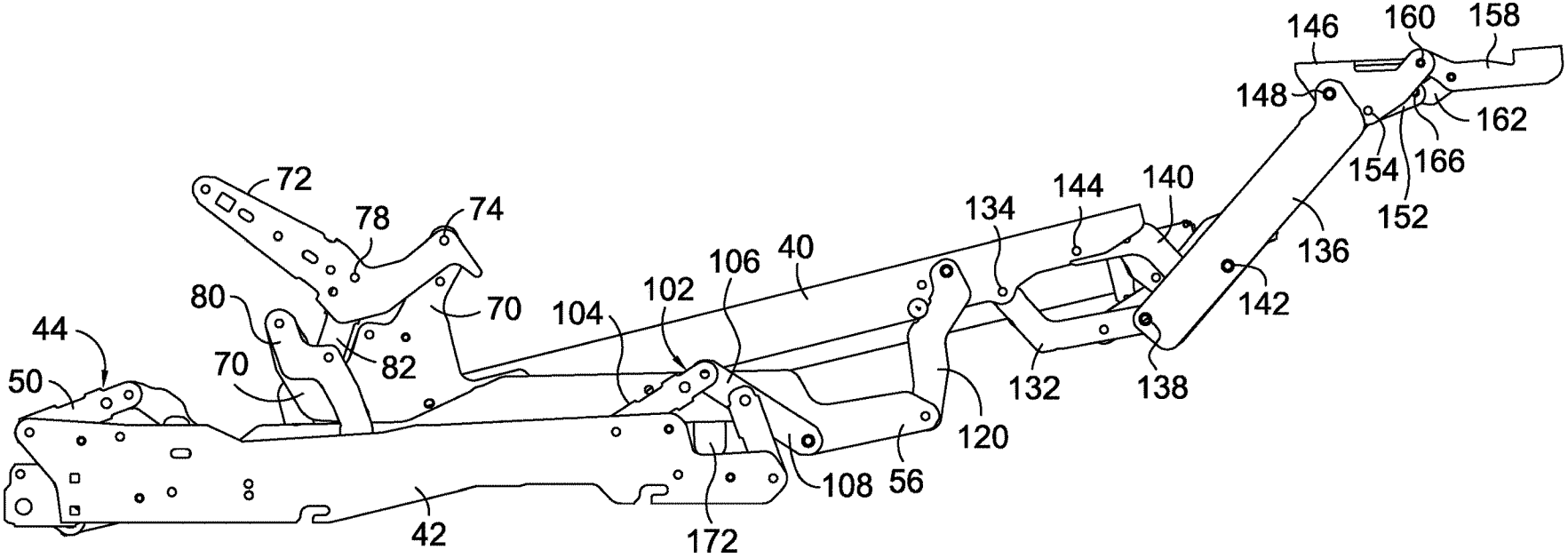
FIG. 13 a side view of the linkage mechanism in the fully reclined position.
Figure 14:
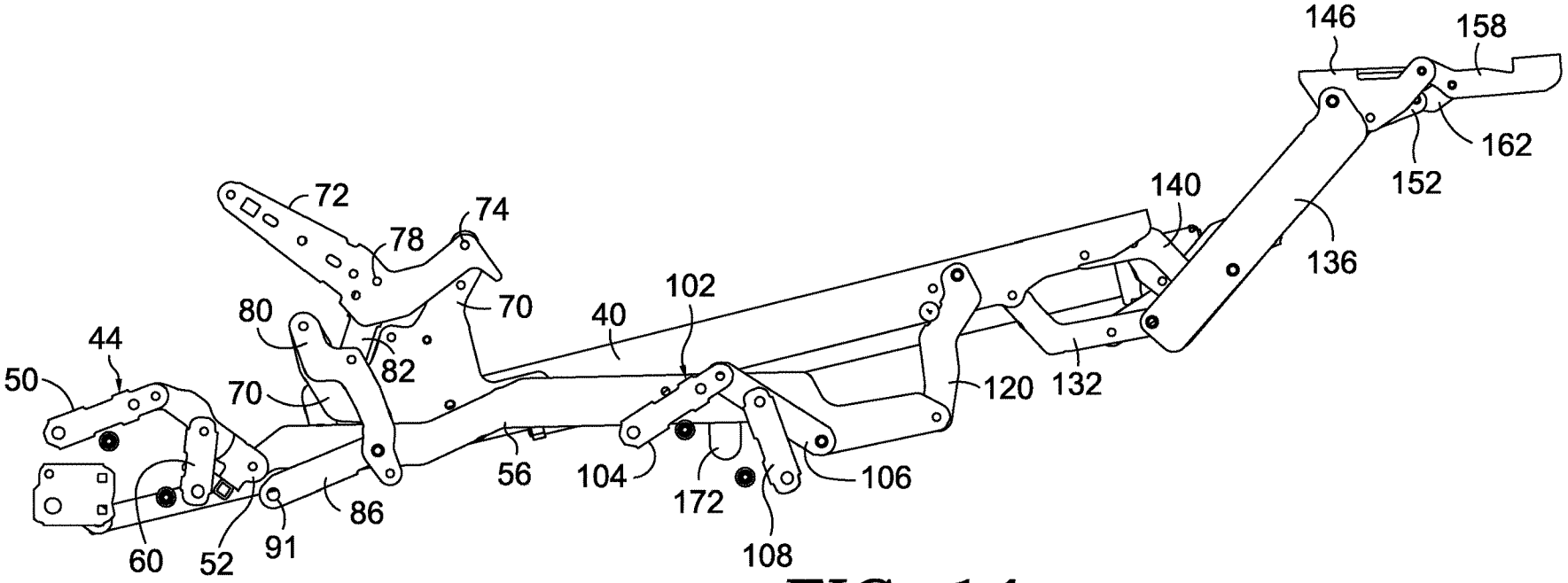
FIG. 14 is a view similar to FIG. 13, but shown without the arm plate.
Figure 15:
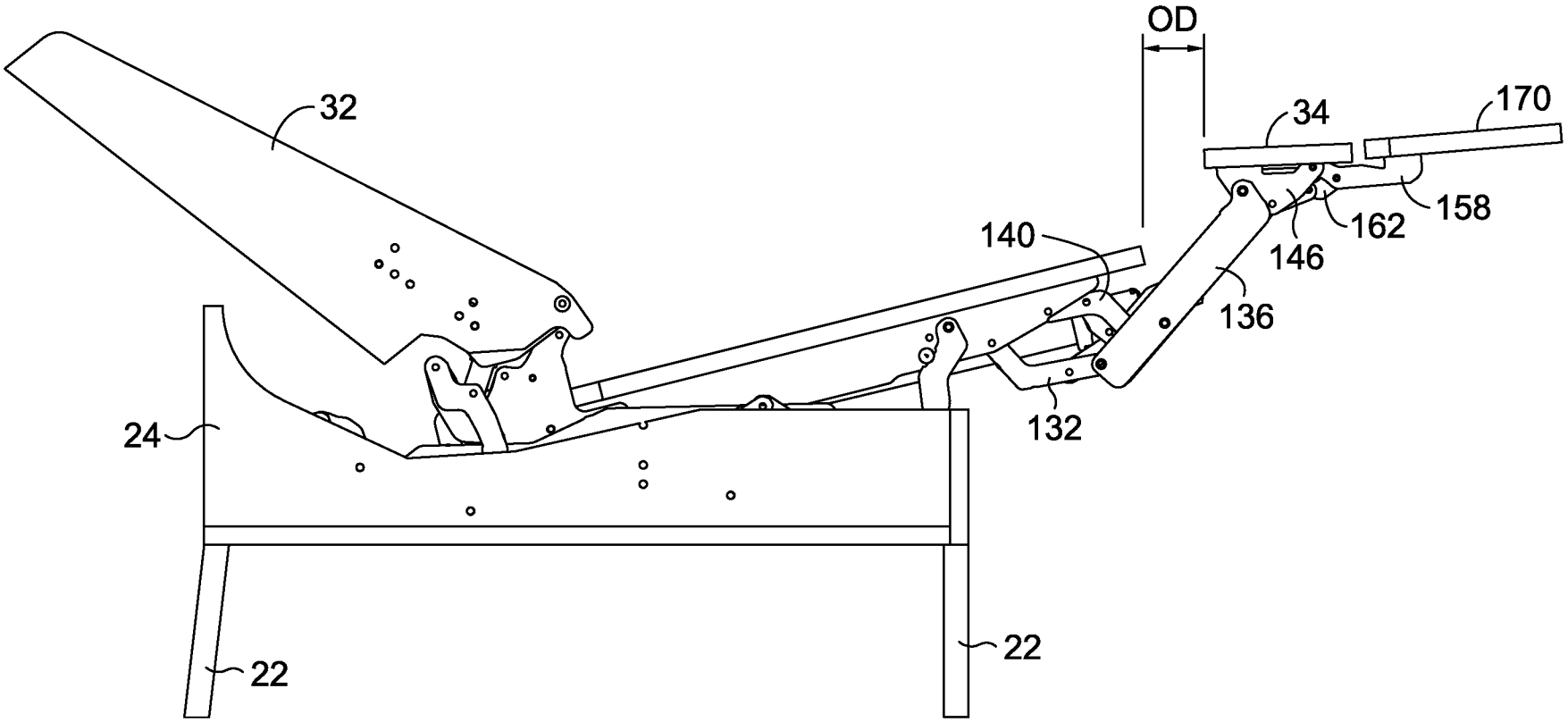
FIG. 15 is a side view of the seating unit in the fully reclined position.

Turning to FIGS. 5 and 6, a front recline linkage 102 is coupled between the arm mounting plate 42 and the trolley link 56. The front recline linkage 102 includes a control link 104, a front travel link 106 and a pivot control link 108. The control link 104 is pivotally coupled to the arm mounting plate 42 at pivot point 110 on one end, and is pivotally coupled to the front travel link 106 at pivot point 112 on the other end. The end of the front travel link 106 opposite pivot point 112 is pivotally coupled to the trolley link 56 at pivot point 114. The pivot control link 108 is pivotally coupled to the front travel link 106 at pivot point 116 on one end, and is pivotally coupled to the arm mounting plate 42 at pivot point 118 on the other end. The front recline linkage 102 supports the trolley link 56 as the mechanism 26 moves the trolley link 56 forward and upward from the TV position of FIGS. 8 and 9 to the fully-reclined position of FIGS. 12 and 13.

As seen in FIGS. 5 and 6, a front pivot link 120 is pivotally coupled on one end to the trolley link 56 at pivot point 122. The opposite end of the front pivot link 120 is pivotally coupled to the seat rail 40 at pivot point 124. As the mechanism 26 moves from the closed position of FIGS. 4 and 5 to the TV position of FIGS. 8 and 9, the rear pivot link 92 and the front pivot link 120 move the seat rail 40 forwardly.

Figure 8A:
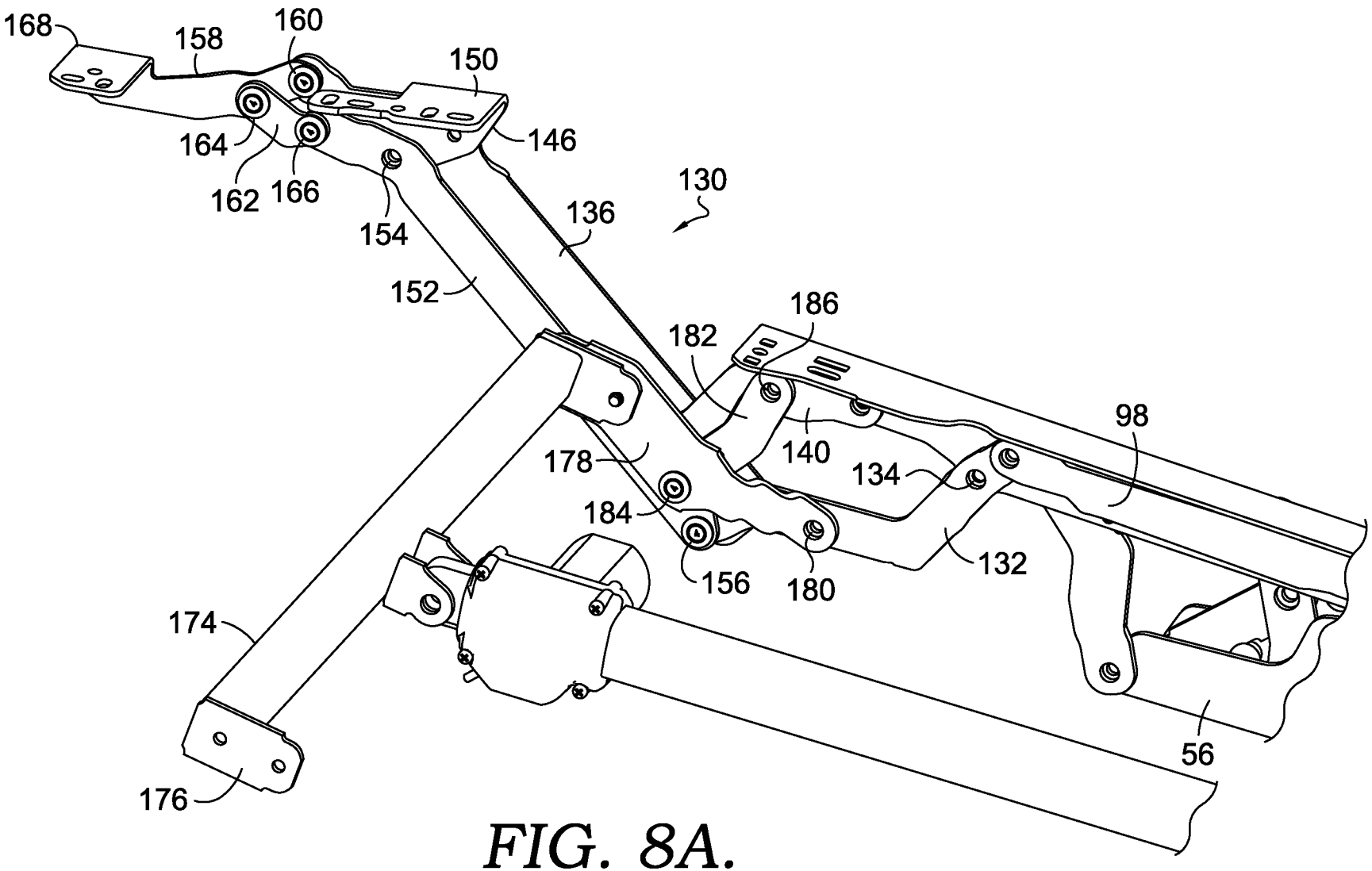
FIG. 8A is an enlarged view of the encircled region 8A in FIG. 8.
Figure 9:
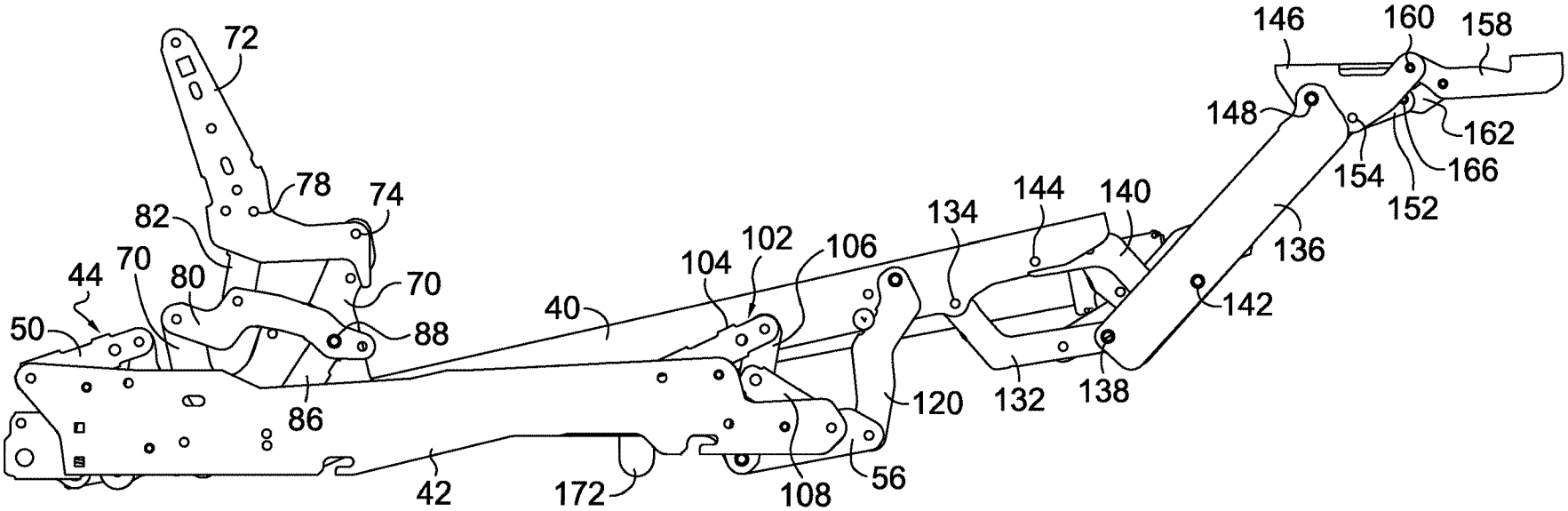
FIG. 9 is a side view of the linkage mechanism in the TV position.
Figure 10:
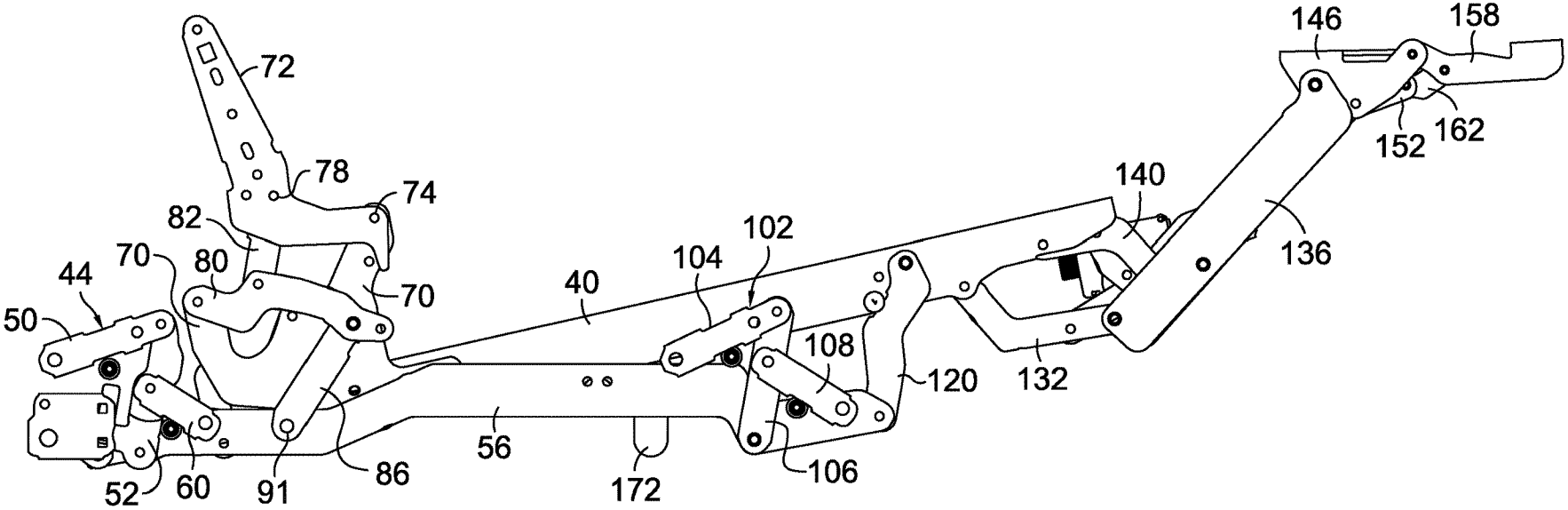
FIG. 10 is a view similar to FIG. 9, but shown without the arm plate.
Figure 11:
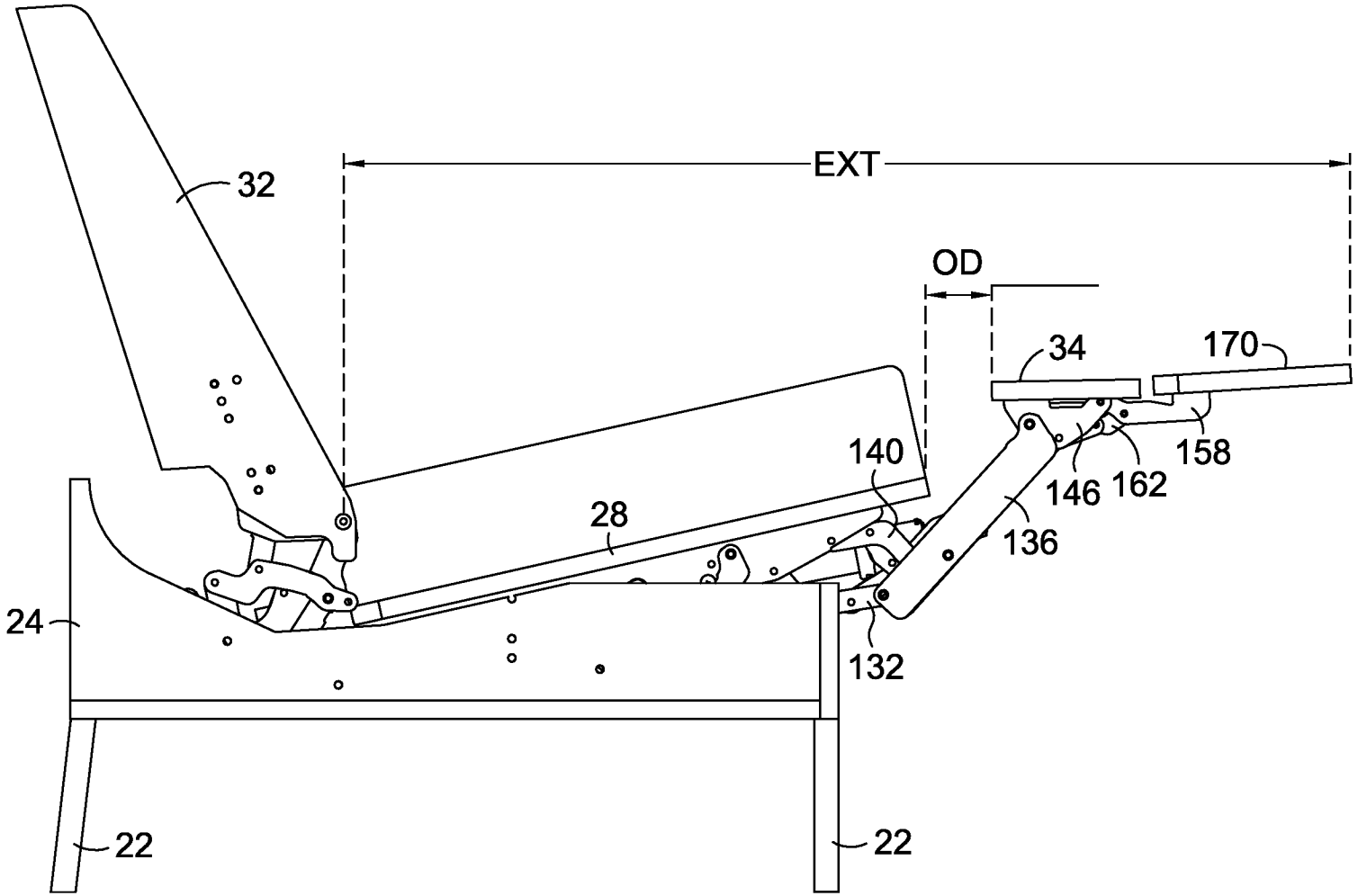
FIG. 11 is a side view of the seating unit in the TV position.

As seen in FIGS. 8A and 9, the mechanism 26 includes an ottoman linkage 130 that controls the extension of the ottoman 34 as it extends from the closed position to the TV position. The ottoman linkage 130 includes a rear ottoman link 132 that is pivotally coupled to the seat rail 40 at pivot point 134. As seen in FIG. 9, the opposite end of the rear ottoman link 132 is pivotally coupled to an outside ottoman link 136 at pivot point 138. A front ottoman link 140 is pivotally coupled to the outside ottoman link 136 at pivot point 142, spaced from pivot point 138. The other end of the front ottoman link 140 is pivotally coupled to the seat rail 40 at pivot point 144. In some aspects, pivot point 144 defines the upper extent of the MH2 measurement. In some aspects, the front ottoman link 140 and the rear ottoman link 132 are shorter than in other mechanisms. This, in part, allows the ottoman linkage to rotate farther up when in the closed position as compared to other mechanisms, allowing MH2 to be less than on other mechanisms. In some aspects, the front ottoman link 140 is less than 8 inches, or less than 7 inches, or less than 6 inches, and in some aspects, is about 5 inches long. In some aspects, the rear ottoman link 132 is less than 6.5 inches, or less than 6 inches. The other end of the outside ottoman link 136 is pivotally coupled to a main ottoman bracket 146 at pivot point 148. As seen in FIGS. 8A and 11, the main ottoman bracket 146 has in inwardly extending flange 150 that is used to mount the ottoman 34 to the main ottoman bracket 146. As seen in FIG. 8A, an inside ottoman link 152 is also pivotally coupled to the main ottoman bracket 146 at pivot point 154. The opposite end of the inside ottoman link 152 is pivotally coupled to the rear ottoman link 132 at pivot point 156. A flipper ottoman bracket 158 is also pivotally coupled to the main ottoman bracket 146 at pivot point 160. As seen in FIG. 8A, a drive link 162 is pivotally coupled on one end to the flipper ottoman bracket 158 at pivot point 164 and is pivotally coupled on the other end to the inside ottoman link 152 at pivot point 166. The flipper ottoman bracket 158 has an inwardly extending flange 168 that is used to mount a flipper ottoman 170 (see FIG. 11) to the flipper ottoman bracket 158.

The mechanism height MH2 (as seen in FIG. 2) can be measured from the lowest point of the linkage mechanism 26 (for example, in some aspects, the lowest point of the outside ottoman link 136 in the closed position of FIG. 5) to an upper point just above the upper-most point of the front pivot link 120 (with the linkage mechanism in the closed position of FIG. 5). In some aspects, MH2 can be in the range of 140-160 mm.

The front ottoman link 140 and the rear ottoman link 132 are shorter than similar links used in prior mechanisms. This results in the ottoman 34 being nearer to the end of the seat rail 40 (and the end of the seat 30) than in some prior mechanisms. As seen in FIG. 11, the distance from the front of the seat rail 28 to the back of the ottoman 34 (when in the TV position) can be seen as a distance OD. In some aspects, with the shorter front ottoman link 140 and rear ottoman link 132, the distance OD can be such that, when upholstered and finished, provides a smaller gap that does not require a mid-ottoman. In the finished, upholstered state, the distance OD allows the gap between the front of the upholstered seat and the back of the upholstered ottoman to be less than five inches. So, with the main ottoman 34 this near the end of the seat rail 40, there is not a need for an auxiliary ottoman in the gap between the ottoman 34 and the seat 30. To add length to support a user's lower legs, the flipper ottoman 170 is extended in front of the ottoman 34. The flipper ottoman 170 allows the overall extension from the back of the seat 30 to the front of the flipper ottoman 170 (labeled EXT in FIG. 11) to be of a length comfortable for users. In some aspects, the distance EXT is about forty inches. The shorter rear ottoman link 132 and front ottoman link 140 also allow the ottoman 34 to be further off the floor in the closed position (allowing a higher leg height (LH), a lower seat height (SH) and/or a reduced mechanism height (MH1 or MH2) while hiding the links of the mechanism 26 from view (hidden by the side frame 24 without needing to alter the lower edge of the side frame 24). This allows designers of high-leg seating more flexibility and a clean look.

As described above, a rear stabilizer tube 66 extends between opposing rear travel links 52 at the rear of the mechanism 26. Similarly, a front stabilizer tube 172 is coupled to, and extends between, opposing trolley links 56. As best seen in FIG. 8, the rear stabilizer tube 66, in some aspects, includes a section with an upward bend in the middle. Further, in some aspects, the front stabilizer tube 172 includes a section with a downward bend in the middle. The bends in the rear stabilizer tube 66 and the front stabilizer tube 172 provide clearance for the motor 64. As described above, the motor 64 is pivotally coupled on one end to the rear motor tube 63. The other end of the motor 64 is pivotally coupled to a front motor tube 174. In some aspects, the front motor tube 174 includes end brackets 176. The end bracket 176 is fixedly coupled to a motor drive link 178. The end of the motor drive link 178 opposite the end bracket 176 is pivotally coupled to the rear ottoman link 132 at pivot point 180, as seen in FIG. 8A. About midway between the two ends of the motor drive link 178, a motor control link 182 is pivotally coupled to the motor drive link 178 at pivot point 184. The opposite end of the motor control link 182 is pivotally coupled to the front ottoman link 140 at pivot point 186. The motor drive link 178 is thus coupled to both the rear ottoman link 132 and the front ottoman link 140 (via the motor control link 182). As the rear ottoman link 132 and the front ottoman link 140 rotate from the closed position to the TV position, the motor drive link 178 and the motor control link 182 cooperate to restrict the up-and-down movement of the front motor tube 174 (and thus the motor 64). This results in a more linear movement of the front motor tube 174 and the motor 64 as the motor 64 moves the mechanism 26 from the closed position to the TV position, requiring less vertical space for the motor 64. In other words, the front of the motor 64, where it mounts to the front motor tube 174, does not swing down and then back up as much as it would if it were coupled to only the rear ottoman link 132 or the front ottoman link 140. This also allows for a very compact, powered mechanism, allowing the motor 64 to clear the front stabilizer tube 172, while also allowing a very shallow downward bend in the front stabilizer tube 172, such that the front stabilizer tube 172 remains hidden from view in the closed position.

Figure 7:
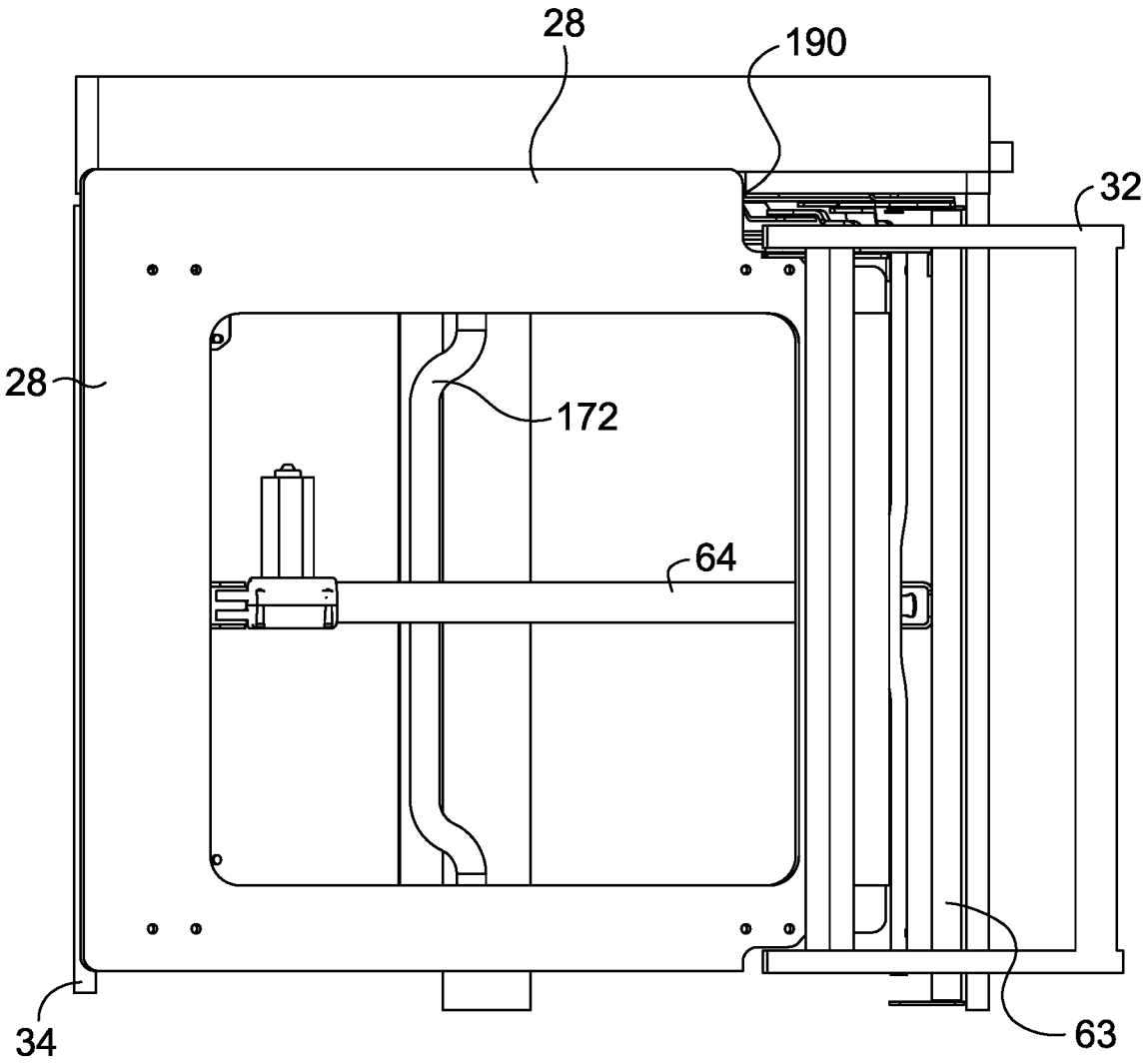
FIG. 7 is a top view of the seating unit, showing a seat frame.

Further, as described above the rear recline linkage 44 is moved upwardly and rearwardly compared to prior mechanisms, more effectively utilizing the space rearward of the seat rail 40. As seen in FIG. 6, the rear recline linkage 44 (including the control link 50, the rear travel link 52 and the pivot control link 60) are all rearwardly of pivot point 74 when the mechanism 26 is in the closed position of FIG. 6. In some aspects, the rear recline linkage 44 is rearwardly of a notch 190 (see FIG. 7) in the seat frame 28. Additionally, at least some portion of the rear recline linkage 44 is above the seat rail 40 when the mechanism 26 is in the closed position. The mechanism height (MH1 or MH2) is reduced, in part, by moving the rear recline linkage 44 to this location (allowing a higher leg height (LH), a lower seat height (SH) or a combination thereof while hiding the links of the mechanism 26 from view). This again allows designers of high-leg seating more flexibility and a clean look.

As would be understood by those in the art, the motor 64 may be activated to move the seating unit 20 between the closed position of FIGS. 2-7 to the TV position of FIGS. 8-11 and to the fully-reclined position of FIGS. 12-15 (and then reversing the movement back to the closed position). Using the mechanism 26, furniture designers and manufacturers can design a high-leg seating unit 20 with a higher leg height (LH), a lower seat height (SH) or some combination thereof due to the reduced mechanism height (MH1 or MH2). In some aspects, MH2 is in the range of 140 mm to 160 mm, compared to prior mechanisms of 170 mm or more.

Figure 16:
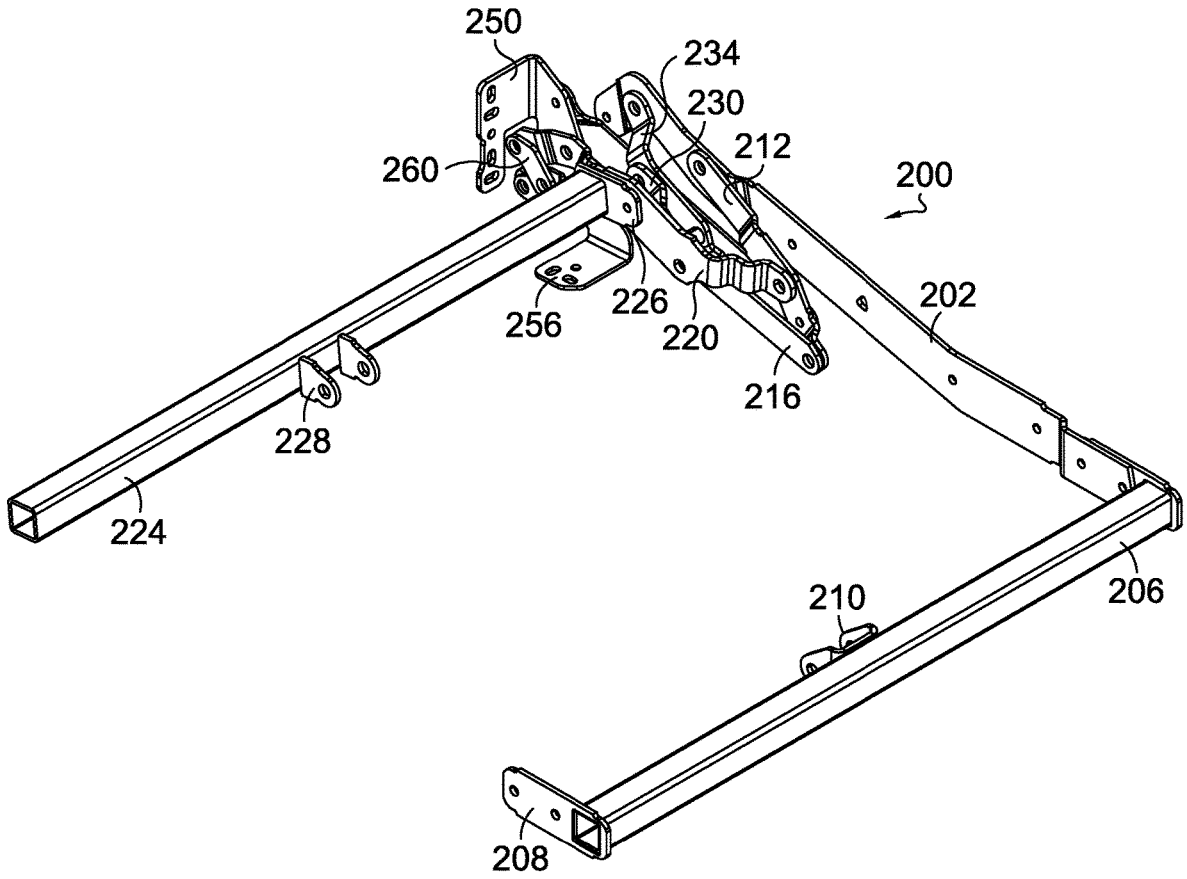
FIG. 16 is a perspective view of an alternative aspect of a mechanism for use on a chair where the ottoman is extendable, but the seat and back remain stationary.
Figure 17:
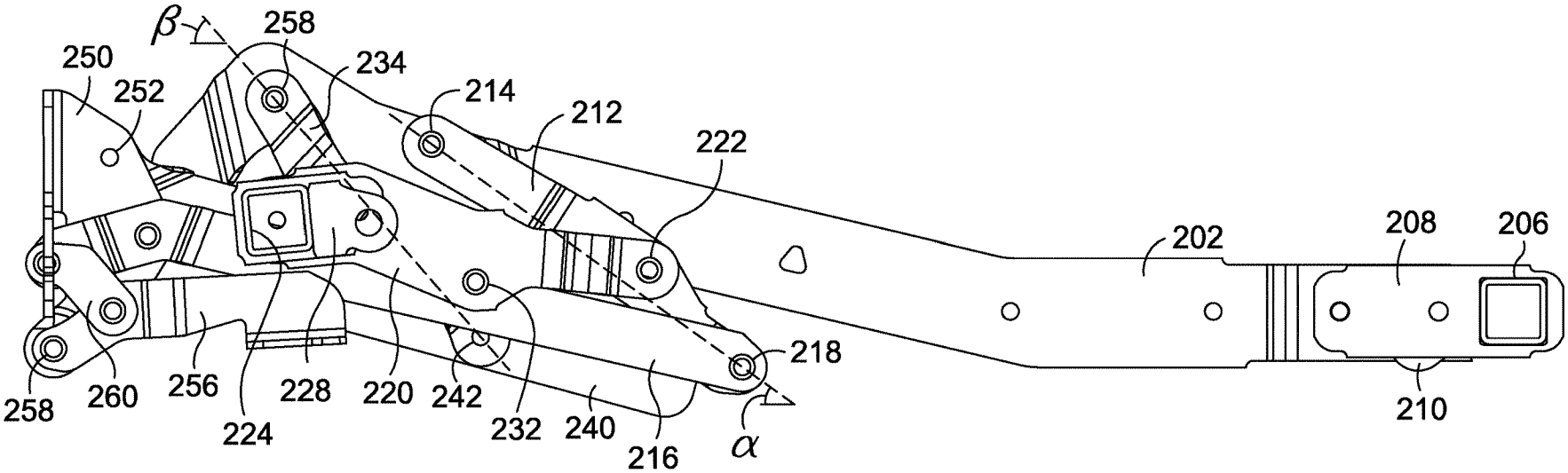
FIG. 17 is an inside elevation view of the mechanism of FIG. 16.
Figure 18:
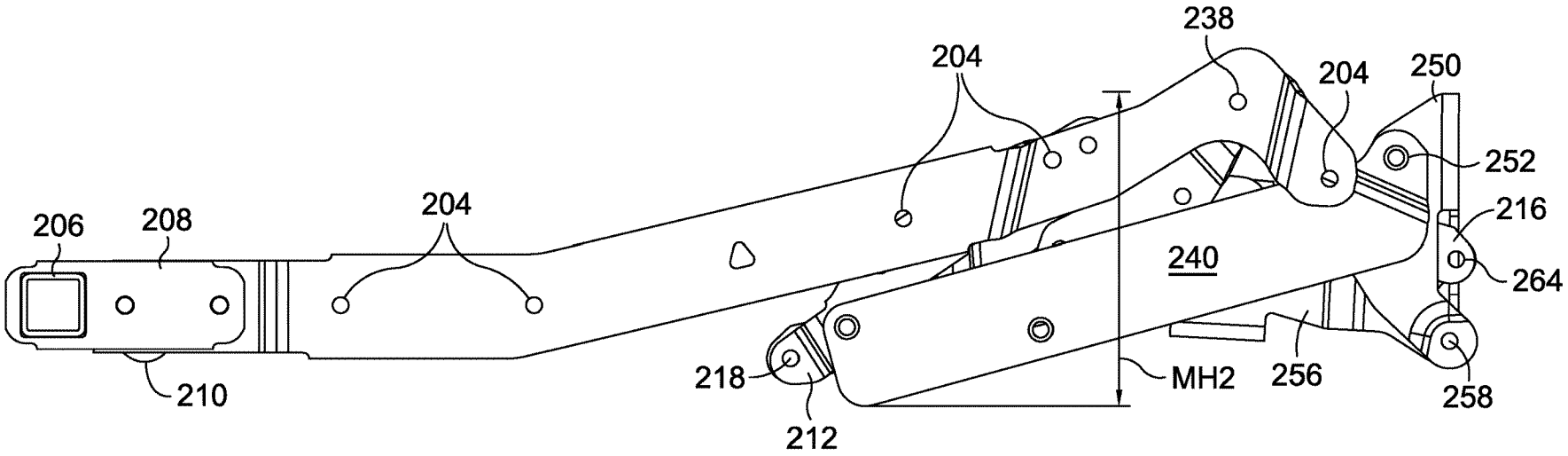
FIG. 18 is an outside elevation view of the mechanism of FIG. 16.
Figure 19:
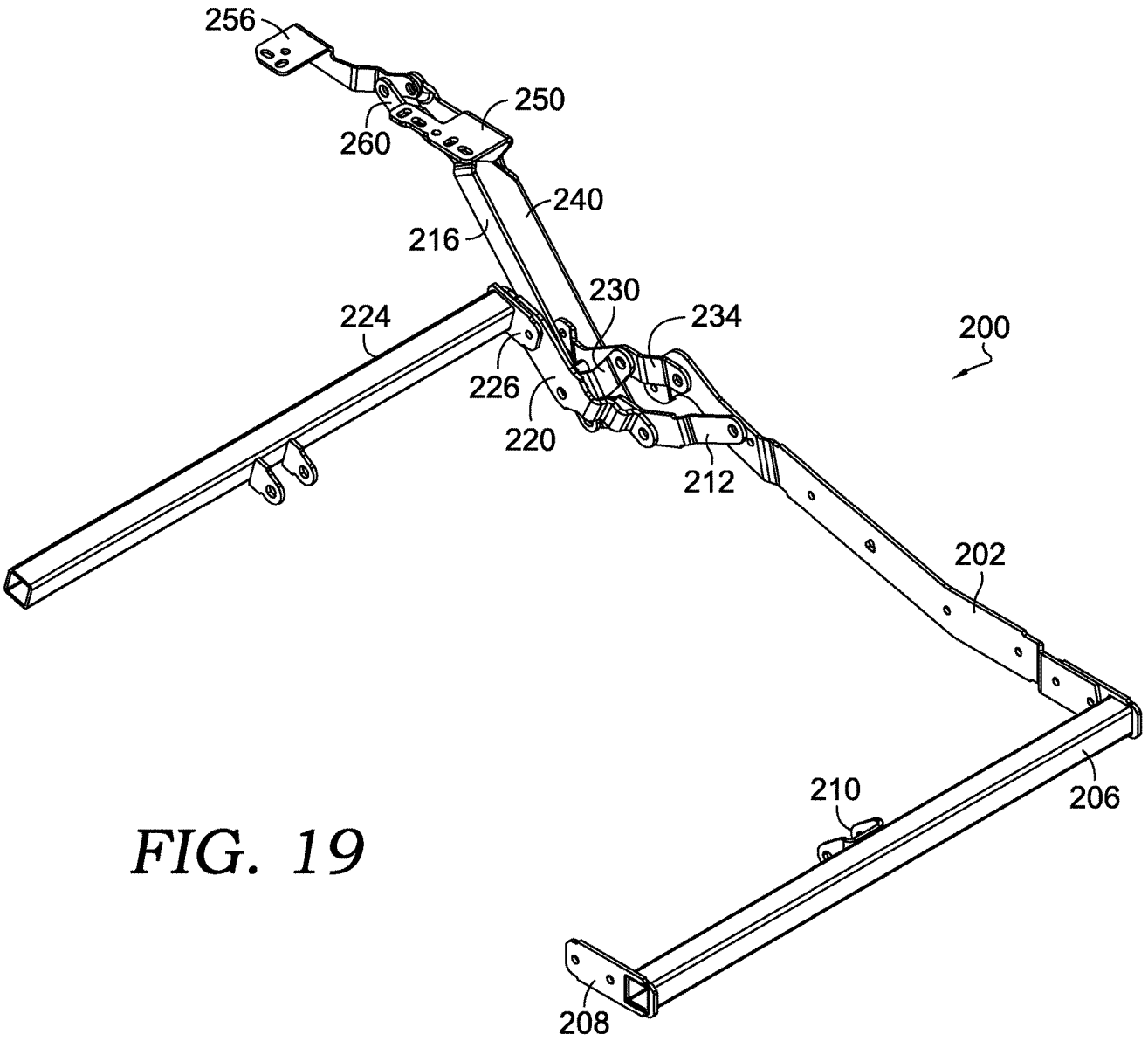
FIG. 19 is a view similar to FIG. 16, but shown with the ottoman linkage extended.
Figure 20:
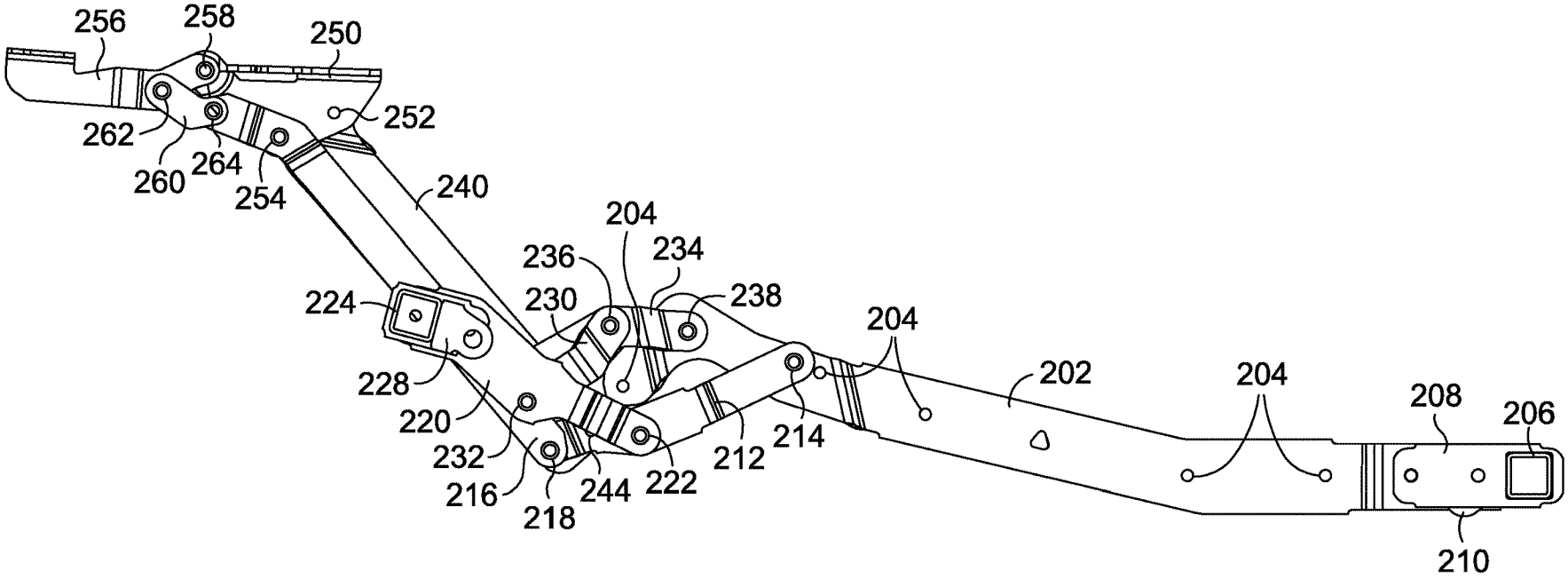
FIG. 20 is an inside elevation view of the mechanism of FIG. 19.
Figure 21:
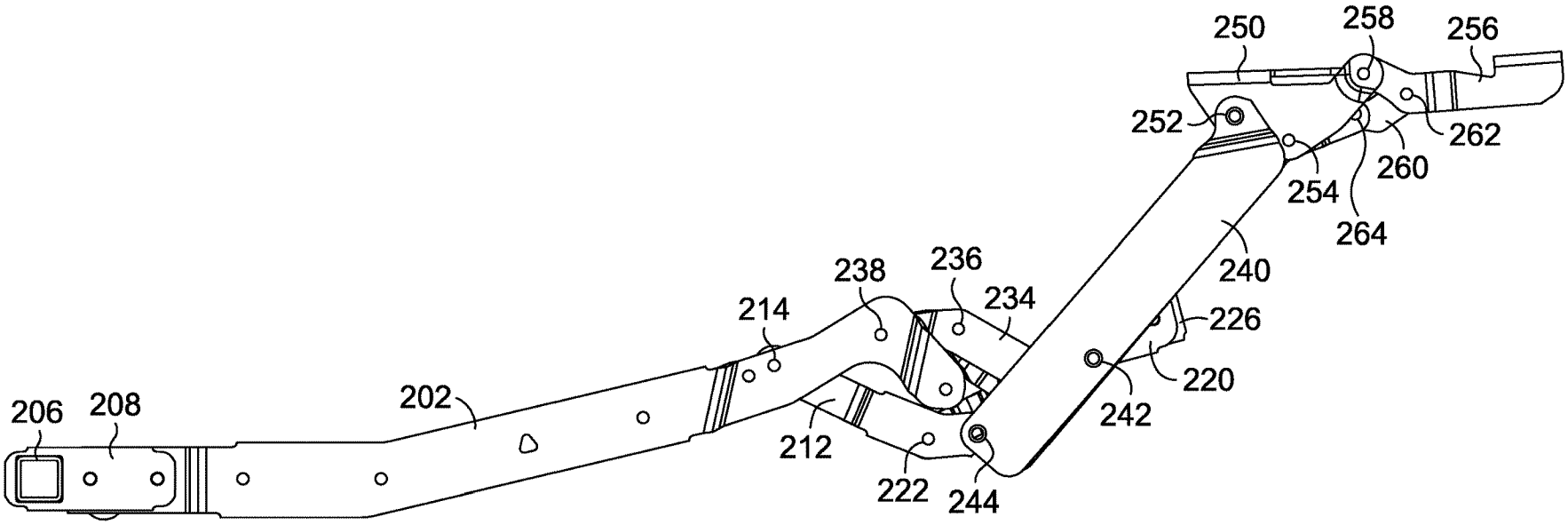
FIG. 21 is an outside elevation view of the mechanism of FIG. 19.

In an alternative embodiment, as shown in FIGS. 16-21, a mechanism 200 is depicted that is usable on a chair designed to have a stationary seat and back, with a moveable ottoman. FIGS. 16-18 depict the mechanism 200 in a closed position, and FIGS. 19-21 depict the mechanism 200 in an extended or TV position. The mechanism 200 provides a compact and lightweight design, usable on a chair with high-leg styling in an unobtrusive way.

As seen in FIG. 16, the mechanism 200 includes a mounting plate 202 that is used to couple the mechanism 200 to the sides or arms of a chair on which mechanism 200 is used. In some aspects, the mounting plate 202 has a series of mounting holes 204 (as best seen in FIG. 18) to couple the mounting plate 202 to the sides or arms of the chair. As seen in FIG. 16, a motor tube 206 may be coupled to, and extend between, opposing mounting plates 202 with end brackets 208. The end brackets 208 may be fixedly coupled to the motor tube 204, such as by welding, and to the mounting plate 202, such as by bolting or riveting. It should be understood that FIGS. 16-21 show a mechanism with only one side of the linkage for clarity, but that the other side would be a mirror image. As seen in FIGS. 16 and 19, a motor bracket 210 is fixedly coupled to the motor tube 204, generally midway along the motor tube 204. The motor bracket 210 is used to pivotally couple an ottoman motor to the motor tube 206 (the ottoman motor is not shown, but its location and function would be understood by those of skill in the art).

As best seen in FIGS. 20 and 21, a rear ottoman link 212 is pivotally coupled to the mounting plate 202 at pivot point 214. The end of the rear ottoman link 212 opposite pivot point 214 is pivotally coupled to an inside ottoman link 216 at pivot point 218. Between pivot point 212 and pivot point 218, the rear ottoman link 212 is pivotally coupled to a motor drive link 220 at pivot point 222. The outer end of the motor drive link 220 is fixedly coupled to a front motor tube 224. In some aspects, the front motor tube 224 is coupled to the motor drive link 220 via a pair of end brackets 226 fixed to the front motor tube 224, such as by welding. The end brackets 226 can, in turn, be fixed to the motor drive link 220, such as by bolting or riveting. A front motor bracket 228 is fixedly coupled to the front motor tube 224, generally midway along the front motor tube 224, and in alignment with the rear motor bracket 210. As would be understood by those of skill in the art, a motor could be pivotally mounted between the rear motor bracket 210 and the front motor bracket 228.

As seen in FIG. 20, the motor drive link 220 is also pivotally coupled to a motor control link 230 at pivot point 232. The end of the motor control link 230 opposite pivot point 232 is pivotally coupled to a front ottoman link 234 at pivot point 236. As seen in FIG. 20, the upper end of the front ottoman link 234 is pivotally coupled to the mounting plate 202 at pivot point 238. The linkage of the motor drive link 220 and the motor control link 230 thus couples the rear ottoman link 212 to the front ottoman link 234. As seen in FIG. 21, the end of the front ottoman link 234 opposite pivot point 238 is pivotally coupled to an outside ottoman link 240 at pivot point 242. The rear ottoman link 212 is also pivotally coupled to the outside ottoman link 240, at pivot point 244. In some aspects, pivot point 238 defines the upper extent of the MH2 measurement, and the lowest extent of MH2 is lowest extent of the mechanism 200 when in the closed position. In some aspects, the front ottoman link 234 and the rear ottoman link 212 are shorter than in other mechanisms. This, in part, allows the ottoman linkage to rotate farther up when in the closed position as compared to other mechanisms, allowing MH2 to be less than on other mechanisms. In some aspects, the length of the front ottoman link 234 is less than 8 inches, or less than 7 inches, or less than 6 inches, and in some aspects, is about 5 inches long. In some aspects, the length of the rear ottoman link 212 is less than 6.5 inches, or less than 6 inches.

The outside ottoman link 240 extends from pivot point 244 and is pivotally coupled at its other end to an ottoman bracket 250 at pivot point 252. As seen in FIG. 20, the ottoman bracket 250 is also pivotally coupled to the inside ottoman link 216 at pivot point 254. Also, as seen in FIG. 21, the ottoman bracket 250 is pivotally coupled to a flipper ottoman bracket 256 at pivot point 258. The flipper ottoman bracket 256 is also pivotally coupled to a flipper drive link 260 at pivot point 262. The other end of the flipper drive link 260 is pivotally coupled to the outer end of the inside ottoman link 216 at pivot point 264.

Figure 22:
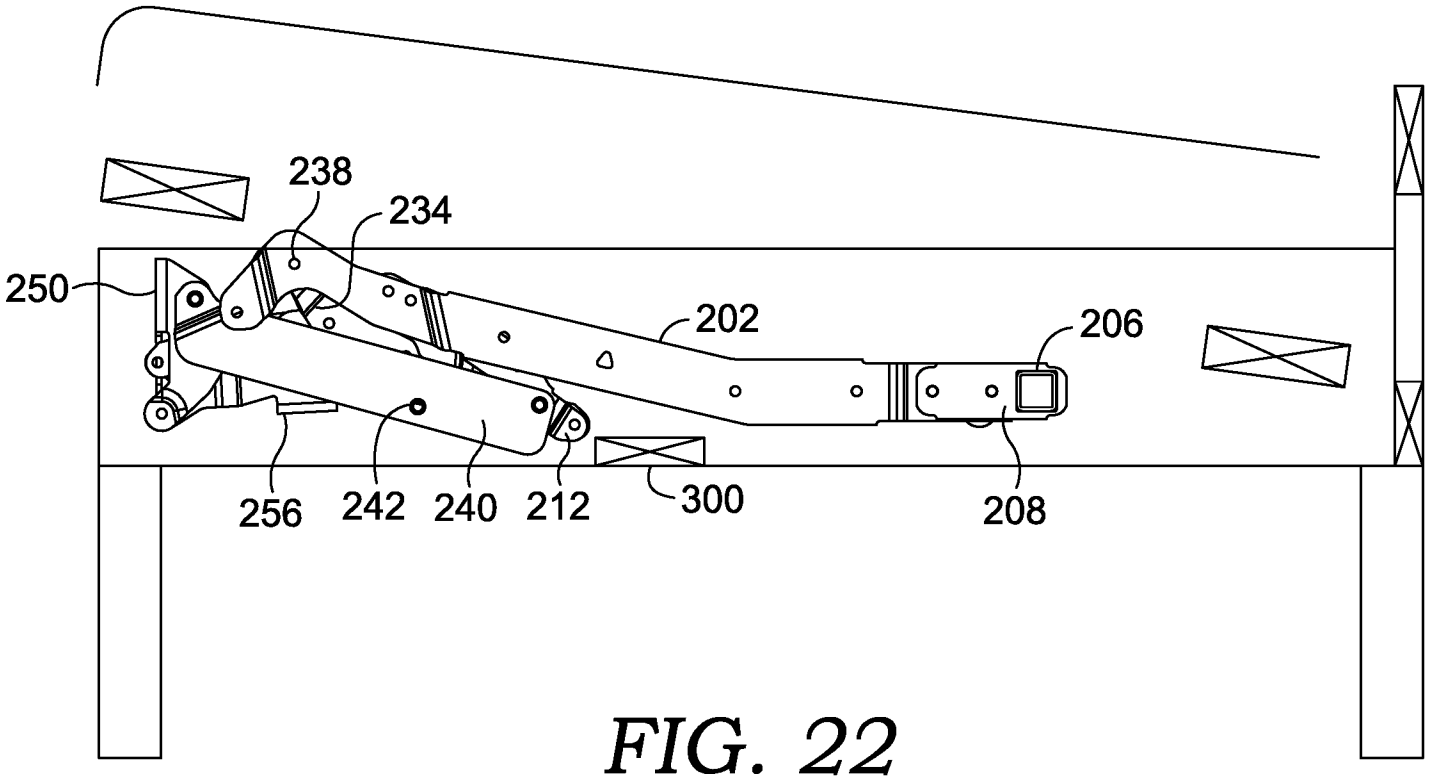
FIG. 22 is a view of the mechanism of FIG. 16, shown within the context of a partial seat frame.

With an ottoman motor pivotally coupled between the rear motor bracket 210 and the front motor bracket 228, the mechanism 200 can be moved from the stowed position of FIGS. 16-18, with the ottoman bracket 250 and the flipper ottoman bracket 256 in a closed position, to the extended or TV position of FIGS. 19-21, with the ottoman bracket 250 and the flipper ottoman bracket 256 in the extended position. When in the closed position, the mechanism 200 offers a compact design, requiring little vertical space from pivot point 238 to the lowest extent of the mechanism 200 (e.g., the bottom of the outside ottoman link 240 in the closed position). The linkage of the motor drive link 220, the motor control link 230 and their connection between the front ottoman link 234, the rear ottoman link 212 and the motor drive tube 224 drive the motor drive tube 224 in a nearly linear motion (without the motor drive tube 224 arcing downward and the upward). The mechanism 200 thus offers furniture manufacturers the option of offering an extending ottoman (supported by ottoman bracket 250 and flipper ottoman bracket 256), with a stationary seat and back, all in a compact, lightweight design, which may be offered on a high-leg styled chair. For context, the mechanism 200 is shown in FIG. 22 within the framing of a seat. FIG. 22 shows a typical bracing support 300 generally midway along the seat frame. By employing shorter front ottoman links 234, and rear ottoman links 212, the mechanism can rotate more in going to the closed position, without running into the support 300. The additional rotation allows the mechanism 200 to be used on a chair with a higher leg distance (LH) and a lower seat height (SH) if desired when styling the chair (or on a chair with a comparable SH, but a higher LH), because the mechanism 200 has a lower mechanism height (MH2). As shown in FIG. 17, the front ottoman link 234, in the closed position, may form an angle $\beta$ relative to horizontal that is less than in prior mechanisms, due to the additional rotation allowed by the shorter front ottoman link 234. In some aspects, the angle $\beta$ is less than 50 degrees, and in some aspects, is about 48 degrees. As also shown in FIG. 17, the rear ottoman link 212, in the closed position, may form an angle $\alpha$ relative to horizontal that is less than in prior mechanisms, due to the additional rotation of the rear ottoman link 212. In some aspects, the angle α is less than 45 degrees, or less than 40 degrees, or less than 35 degrees and in some aspects is about 30 degrees. The ottoman linkage 130 discussed above with respect to FIGS. 2-15 has similar ranges for the angles of the front and rear ottoman links.

From the foregoing, it will be seen that this invention is one well adapted to attain all the ends and objects hereinabove set forth together with other advantages, which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The invention claimed is:

1. An ottoman linkage usable on a high leg seating unit, the ottoman linkage comprising:

a four-bar linkage, comprising a front ottoman link pivotally coupled to a bracket at an upper pivot point, the four-bar linkage moveable between at least a closed position and an extended position;

an ottoman bracket coupled to the four-bar linkage; and a flipper ottoman bracket coupled to the ottoman bracket and the four-bar linkage;

wherein the ottoman linkage has a mechanism height measured from the upper pivot point to a lower-most extent of the ottoman linkage in the closed position, and wherein the mechanism height is less than 160 millimeters.

2. The ottoman linkage of claim 1, wherein the front ottoman link is less than 8 inches.

3. The ottoman linkage of claim 1, wherein the front ottoman link is less than 7 inches.

4. The ottoman linkage of claim 1, wherein the four-bar linkage further comprises a rear ottoman link pivotally coupled to the bracket at a second upper pivot point, the ottoman linkage further comprising a motor drive linkage comprising:

a rear motor support tube;

a front motor drive tube;

a motor having an extendable shaft coupled between the rear motor support tube and the front motor drive tube;

a motor drive link having a first end fixedly coupled to the front motor drive tube and a second end pivotally coupled to the rear ottoman link; and a motor control link having a first end pivotally coupled to the front ottoman link and a second end pivotally coupled to the motor drive link;

wherein the motor control link and the motor drive link rotate the front ottoman link and the rear ottoman link as the motor moves the front ottoman drive tube.

5. The ottoman linkage of claim 4, wherein the motor drive link and the motor control link indirectly couple the front motor drive tube to the front ottoman link and allows the front motor drive tube to move linearly from the closed position to the extended position.

6. The ottoman linkage of claim 1, wherein ottoman linkage is usable on a seating unit having a leg height of at least about 8 inches, and a seat height of between 18 and 20 inches, and wherein the mechanism height allows the ottoman linkage to be obscured from view.

7. The ottoman linkage of claim 1, wherein the bracket is a mounting plate fixedly coupled to the seating unit.

8. The ottoman linkage of claim 1, wherein the end of the rear ottoman link opposite the upper pivot point is pivotally coupled to another link of the four-bar linkage at a lower pivot point, and wherein a line extending from the upper pivot point to the lower pivot point in the closed position forms an angle relative to horizontal of less than 45 degrees.

* * * * *